US005573882A

United States Patent [19]

Larson et al.

[11] Patent Number: 5,573,882

[45] Date of Patent: Nov. 12, 1996

[54] LIQUID DEVELOPER COMPOSITIONS WITH CHARGE DIRECTOR BLOCK COPOLYMERS

[75] Inventors: James R. Larson, Fairport; John W. Spiewak, Webster, both of N.Y.

[73] Assignee: Xerox Corporation, Stamford, Conn.

[21] Appl. No.: 519,265

[22] Filed: Aug. 25, 1995

[51] Int. Cl.[6] ..... G03G 9/13

[52] U.S. Cl. ..... 430/115; 430/117

[58] Field of Search ..... 430/114, 115, 430/119, 117

[56] References Cited

U.S. PATENT DOCUMENTS

| | | | |
|---|---|---|---|
| 5,019,477 | 5/1991 | Feider | 430/115 |
| 5,306,591 | 4/1994 | Larson et al. | 430/115 |
| 5,397,672 | 3/1995 | Larson et al. | 430/115 |
| 5,407,775 | 4/1995 | Larson et al. | 430/115 |
| 5,411,834 | 5/1995 | Fuller et al. | 430/115 |
| 5,484,679 | 1/1996 | Spiewak et al. | 430/115 |

*Primary Examiner*—John Goodrow
*Attorney, Agent, or Firm*—E. O. Palazzo

[57] ABSTRACT

A negatively charged liquid developer comprised of a nonpolar liquid, thermoplastic resin particles, pigment, a charge adjuvant, and a BAB polymer charge director wherein A and B represent the polar and nonpolar polymer segments, respectively.

22 Claims, No Drawings

LIQUID DEVELOPER COMPOSITIONS WITH CHARGE DIRECTOR BLOCK COPOLYMERS

BACKGROUND OF THE INVENTION

This invention is generally directed to liquid developer compositions and, more specifically, to liquid developers containing BAB quaternary block copolymer charge directors. More specifically, the charge directors of the present invention are derived from alkyl or proton quaternized 2-ethylhexyl methacrylate-co-2-dimethylaminoethyl methacrylate, (EHMA/DMAEMA) BAB or B(AA')B triblock copolymers, and specifically derived from the alkylation or protonation of poly-2-ethylhexyl methacrylate-co-2-N,N-dimethylaminoethyl methacrylate (EHMA-DMAEMA) with alkylating agents or Bronsted acids, and wherein the resulting developers possess high charging levels, excellent more rapid initial charging rates, excellent conductivity characteristics, and wherein the mobility of developers prepared from these charge directors is about as effective as that of the corresponding AB block polymers, it is believed, since the BAB polymer charge directors of the present invention are soluble in the liquid of the developer. The BAB charge directors of the present invention are preferably comprised of two nonpolar B block components and one polar ammonium A or (AA') block component.

The developers of the present invention can be selected for a number of known imaging and printing systems, such as xerographic processes, wherein latent images are rendered visible with the liquid developer illustrated herein. The image quality, solid area coverage and resolution for developed images usually require sufficient toner particle electrophoretic mobility. The mobility for effective image development is primarily dependent on the imaging system used. The electrophoretic mobility is primarily directly proportional to the charge on the toner particles and inversely proportional to the viscosity of the liquid developer fluid. A 10 to 30 percent increase in fluid viscosity caused, for instance, by a 5° C. to 15° C. decrease in temperature could result in a decrease in image quality, poor image development and background development, for example, because of a 5 percent to 23 percent decrease in electrophoretic mobility. Insufficient particle charge can also result in poor transfer of the toner to paper or other final substrates. Poor or unacceptable transfer can result in, for example, poor solid area coverage if insufficient toner is transferred to the final substrate and can also lead to image defects such as smears and hollowed fine features. To overcome or minimize such problems, the liquid toners of the present invention were arrived at after substantial research efforts, and which toners result in, for example, sufficient particle charge for transfer and maintain the mobility within the desired range of the particular imaging system employed. Advantages associated with the present invention include a high developer particle charge over a range of low to medium conductivities; and further increasing the desired negative charge on the developer particles and in embodiments providing a charge director that is superior to similar charge directors like tetraalkyl quaternary ammonium block copolymers, lecithin, and metal salts of petroleum fractions. Some of the aforementioned additives like lecithin contain impurities which can have an adverse effect on their intended function. The superior charge can result in improved image development and superior image transfer. The low to medium conductivity of the dispersions obtained with the present invention improve the developability of the liquid toner dispersion as the high concentration of mobile ions in high conductivity liquid dispersions compete with the toner particles for the latent electrostatic image in the xerographic process. The high concentration of mobile ions, reduced with the present invention, can also disrupt other steps in the xerographic printing process such as the electrostatic transfer of the image from the image bearing member to a substrate. In a number of applications of the xerographic printing process, a subsequent electrostatic image is applied to the image bearing member over a previously developed image. In this process, often referred to as an image-on-image process, a high concentration of mobile ions in the first image would distort the electrostatic latent image being developed in the subsequent development. The desired low to medium conductivity for any given electrostatic printing process will depend on specific features of the printing system and it is, therefore, desirable to have a liquid toner dispersion with an adjustable low conductivity which provides high particle charges over a range of low to medium conductivities.

U.S. Pat. No. 5,019,477, the disclosure of which is totally incorporated herein by reference, discloses a liquid electrostatic developer comprising a nonpolar liquid, thermoplastic resin particles, and a charge director. The ionic or zwitterionic charge directors may include both negative charge directors, such as lecithin, oil-soluble petroleum sulfonate and alkyl succinimide, and positive charge directors such as cobalt and iron naphthanates. The thermoplastic resin particles can comprise a mixture of (1) a polyethylene homopolymer or a copolymer of (i) polyethylene and (ii) acrylic acid, methacrylic acid or alkyl esters thereof, wherein (ii) comprises 0.1 to 20 weight percent of the copolymer; and (2) a random copolymer of (iii) selected from the group consisting of vinyl toluene and styrene, and (iv) selected from the group consisting of butadiene and acrylate.

U.S. Pat. No. 5,030,535 discloses a liquid developer composition comprising a liquid vehicle, a charge control additive and toner particles. The toner particles may contain pigment particles and a resin selected from the group consisting of polyolefins, halogenated polyolefins and mixtures thereof. The liquid developers are prepared by first dissolving the polymer resin in a liquid vehicle by heating at temperatures of from about 80° C. to about 120° C., adding pigment to the hot polymer solution and attriting the mixture, and then cooling the mixture so that the polymer becomes insoluble in the liquid vehicle, thus forming an insoluble resin layer around the pigment particles, may be selected from known thermoplastics, including fluoropolymers.

U.S. Pat. No. 5,026,621 discloses a toner for electrophotography which comprises as main components a coloring component and a binder resin which is a block copolymer comprising a functional segment (A) consisting of at least one of a fluoroalkylacryl ester block unit or a fluoroalkyl methacryl ester block unit, and a compatible segment (B) consisting of a fluorine-free vinyl or olefin monomer block unit. The functional segment of block copolymer is oriented to the surface of the block polymer, and the compatible segment thereof is oriented to be compatible with other resins and a coloring agent contained in the toner whereby the toner is provided with both liquid repelling and solvent soluble properties.

Moreover, in U.S. Pat. No. 4,707,429 there are illustrated, for example, liquid developers with an aluminum stearate charge additive. Liquid developers with charge directors are also illustrated in U.S. Pat. No. 5,045,425.

The disclosures of each of the U.S. patents mentioned herein are totally incorporated herein by reference.

In U.S. Pat. No. 5,364,729, the disclosure of which is totally incorporated herein by reference, there is illustrated a process for forming images which comprises (a) generating an electrostatic latent image; (b) contacting the latent image with a developer comprising a colorant and a substantial amount of a vehicle with a melting point of at least about 25° C., which developer has a melting point of at least about 25° C., the contact occurring while the developer is maintained at a temperature at or above its melting point, the developer having a viscosity of no more than about 500 centipoise and a resistivity of no less than about $10^8$ ohm-cm at the temperature maintained while the developer is in contact with the latent image; and (c) cooling the developed image to a temperature below its melting point subsequent to development.

In U.S. Pat. No. 5,407,775, the disclosure of which is totally incorporated herein by reference, there is illustrated a liquid developer comprised of a liquid, thermoplastic resin particles, a nonpolar liquid soluble charge director comprised of a zwitterionic quaternary ammonium block copolymer wherein both cationic and anionic sites contained therein are covalently bonded within the same polar repeat unit in the quaternary ammonium block copolymer.

In U.S. Pat. No. 5,549,007, the disclosure of which is totally incorporated herein by reference, there is illustrated a liquid developer comprised of a liquid, thermoplastic resin particles, a nonpolar liquid soluble charge director comprised of an ionic or zwitterionic quaternary ammonium block copolymer ammonium block copolymer, and wherein the number average molecular weight thereof of said charge director is from about 70,000 to about 200,000.

In U.S. Pat. No. 5,484,679, the disclosure of which is totally incorporated herein by reference, there are illustrated liquid developers containing block polymer negative charge directors comprised of a total of at least three blocks, ammonium A blocks and nonpolar B blocks in various combinations, and more specifically, triblock copolymers of the formula A—B—A wherein the polar A block is an ammonium containing segment and B is a nonpolar block segment which, for example, provides for charge director solubility in the liquid ink fluid like ISOPAR™, and wherein the A blocks have a number average molecular weight range of from about 200 to about 120,000; the B blocks have a number average molecular weight range of from about 2,000 to 190,000; the ratio of $M_w$ to $M_n$ is 1 to 5; and the total number average molecular weight of the ABA copolymer is, for example, from about 6,200 to about 300,000, and preferably about 200,000.

In U.S. Statutory Invention Registration No. H1483, U.S. Pat. No. 5,306,591, U.S. Pat. No. 5,308,731, the disclosures of which are totally incorporated herein by reference, there is illustrated the following: a liquid developer comprised of a certain nonpolar liquid, thermoplastic resin particles, a nonpolar liquid soluble ionic or zwitterionic charge director, and a charge adjuvant comprised of an aluminum hydroxycarboxylic acid, or mixtures thereof; U.S. Pat. No. 4,306,591 discloses a liquid developer comprised of thermoplastic resin particles, a charge director, and a charge adjuvant comprised of an imine bisquinone; and U.S. Pat. No. 5,308,731 discloses a liquid developer comprised of a liquid, thermoplastic resin particles, a nonpolar liquid soluble charge director, and a charge adjuvant comprised of a metal hydroxycarboxylic acid.

Illustrated in U.S. Pat. No. 5,409,796 is a positively charged liquid developer comprised of thermoplastic resin particles, optional pigment, a charge director, and a charge adjuvant comprised of a polymer of an alkene and unsaturated acid derivative; and wherein the acid derivative contains pendant ammonium groups, and wherein the charge adjuvant is associated with or combined with said resin and said optional pigment; and in U.S. Pat. No. 5,411,834 is a negatively charged liquid developer comprised of thermoplastic resin particles, optional pigment, a charge director, and an insoluble charge adjuvant comprised of a copolymer of an alkene and an unsaturated acid derivative, and wherein the acid derivative contains pendant fluoroalkyl or pendant fluoroaryl groups, and wherein the charge adjuvant is associated with or combined with said resin and said optional pigment.

SUMMARY OF THE INVENTION

It is an object of the present invention to provide liquid developers with many of the advantages illustrated herein.

Another object of the present invention is to provide liquid developers capable of high particle charging and fast toner charging rates.

Another object of the present invention is to provide liquid developers capable of high particle charging and rapid toner charging rates at the same charge director concentrations relative to the charging levels and rates obtained for the corresponding AB diblock, charged liquid developers.

Another object of the invention is to provide a negatively charged liquid developer wherein there are selected as charge directors certain protonated ammonium salt triblock copolymers.

It is still a further object of the invention to provide a liquid developer wherein developed image defects, such as smearing, loss of resolution and loss of density, are eliminated, or minimized.

Also, in another object of the present invention there are provided negatively charged liquid developers with certain protonated ammonium, BAB triblock charge directors, which are superior in embodiments to, for example, AB diblock protonated ammonium block copolymers since, for example, with the BAB there results higher negative toner particle charge from two hours to at least 4 days after charging. A superior charge observed after two hours with, for example, a 1 percent solids yellow developer charged at 5 percent charge director relative to developer solids with the protonated ammonium multiple BAB block copolymer charge director was $-0.92\times10^{-10}$ $m^2/Vs$ versus $-0.46\times10^{-10}$ $m^2/Vs$ for the corresponding yellow developer charged at the same level with the corresponding protonated ammonium (AB) diblock copolymer charge director of the same composition except for the absence of multiple B blocks. After 4 days, the same two yellow liquid developers had mobility values of $-1.87\times10^{-10}$ $m^2/Vs$ versus $-1.56\times10^{-10}$ $m^2/Vs$, respectively.

Another object of the present invention resides in the provision of negatively charged liquid toners with ammonium multiple block copolymers, and wherein in embodiments enhancement of the negative charge of NUCREL® based toners, especially yellow toners, is enhanced; and which multiple block BAB copolymers can be derived from proton quaternized poly[EHMA-DMAEMA] poly(2-ethylhexyl methacrylate-2-dimethylaminoethyl methacrylate), and wherein the triblocks can possess highly organized micelles.

These and other objects of the present invention can be accomplished in embodiments by the provision of liquid developers with certain charge directors. In embodiments, the present invention is directed to liquid developers comprised of a toner or thermoplastic resin, pigment, charge additive and a charge director comprised of ammonium BAB block copolymers. In embodiments, the aforementioned charge director contains one or more nonpolar B blocks and one A block. The B block constituent or component is nonpolar thereby enabling hydrocarbon solubility. The multiple block copolymers can be obtained from group transfer polymerization, and a subsequent polymer modification reaction of the group transfer prepared multiple block copolymer in which the protonated or alkylated ammonium site is introduced into the polar A block. The introduction of the alkylated ammonium site can also simultaneously result in the introduction of an intra-repeat unit Zwitter ion. The group transfer prepared multiple block copolymer containing an alkylated ammonium site can also be further modified to yield an inter-repeat unit Zwitter ion.

Embodiments of the present invention relate to a liquid electrostatographic developer comprised of (A) a nonpolar liquid having a Kauri-butanol value of from about 5 to about 30, and present in a major amount of from about 50 percent to about 95 weight percent; (B) thermoplastic resin particles with, for example, an average volume particle diameter of from about 0.5 to about 30 microns and preferably 1.0 to about 10 microns in average volume diameter, and pigment; (C) a nonpolar liquid soluble ammonium BAB triblock copolymer charge director; and (D) optionally a charge adjuvant compound.

Examples of suitable nonpolar liquid soluble charge directors selected for the developers of the present invention in various effective amounts, such as from about 0.1 to about 20 weight percent of developer solids, include ammonium triblock copolymers BAB wherein the A block is the polar block containing positive charge bearing ammonium sites and the B block is the nonpolar block. The polar and nonpolar blocks in the ammonium block copolymers can be comprised of at least two consecutive polar repeat units or nonpolar repeat units, respectively. When trivalent nitrogen in the polar A block is made tetravalent via protonation, a protonated ammonium salt species is formed as the positive charge bearing site. When the trivalent nitrogen in the polar A block is rendered tetravalent via quaternization with an alkylating agent, a quaternary ammonium species is formed as the positive charge bearing site. When in the formation of a quaternary ammonium species in the polar A block a covalently bonded negative charge bearing site is simultaneously formed, the result is an intra-repeat unit zwitterionic quaternary ammonium site. The B(AA')B triblock contains three different blocks nonpolar/polar/nonpolar but the middle polar block has both quaternized ammonium containing repeat units (the cation part of the Zwitter ion in the A part of the complex AA' block) and conjugate acid anion containing repeat units (the anion part of the Zwitter ion in the A' part of the complex AA' block)]. In the formation of a salt from the neutralization of a Bronsted acid in the polar A' block of a B(AA')B triblock copolymer, the cation from the salt combines with the anion from the quaternized alkylated ammonium site in the polar A block, an inter-repeat unit Zwitter ion is simultaneously formed. Polar A blocks containing at least one protonated ammonium salt or at least one zwitterionic positive and negative charge bearing site in the multiple block copolymer charge directors of this invention can provide charging properties, especially more rapid charging, superior to the corresponding AB diblock (2 blocks) copolymer charge directors.

In embodiments, the ammonium triblock copolymer charge directors are preferably comprised of A and B blocks in the sequence BAB. Examples of A blocks are Polar A Blocks

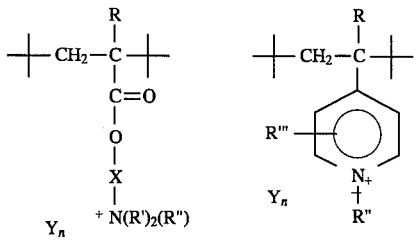

wherein R is hydrogen, alkyl of 1 to about 20 carbons, or cycloalkyl of 3 to about 20 carbons, or aryl of 6 to about 24 carbons, alkylaryl of 7 to about 24 carbons, or cycloalkylaryl of 8 to about 24 carbons; X is alkyl of 2 to about 20 carbons or cycloalkyl of 3 to about 20 carbons, or aryl, alkylaryl, or cycloalkylaryl; R' is alkyl of 1 to about 30 carbons or cycloalkyl of 3 to about 30 carbons, or aryl, alkylaryl or cycloalkylaryl of 6 to about 24 carbons; R" is hydrogen, alkyl of 2 to about 20 carbons or cycloalkyl of 3 to about 20 carbons, or aryl, alkylaryl, cycloalkylaryl, alkylene conjugate acid anion of 1 to about 20 carbons or a cycloalkylene conjugate acid anion of 3 to about 20 carbons, or arylene, alkylarylene, arylalkylene, cycloalkylarylene, or an arylcycloalkylene conjugate acid anion of 6 to about 24 carbons; $Y^-$ is a conjugate acid anion of an acid with a pKa less than or equal to about 4.5, preferably less than 3.0 and, for example, from 0.5 to about 3; n is 0 or 1; n is 0 when R" contains a conjugate acid anion; n is 1 when R" does not contain a conjugate acid anion; and R'" is alkyl of about 1 to about 20 carbons or cycloalkyl of 3 to about 20 carbons, or aryl, alkylaryl, or cycloalkylaryl of 6 to about 24 carbons. Unsubstituted carbons in the pyridine ring are bonded to hydrogen.

Examples of nonpolar B blocks include

Nonpolar B Blocks

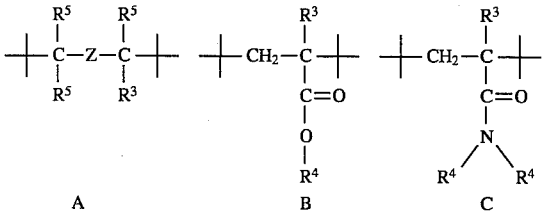

wherein $R^3$ is hydrogen in B and C, or linear or branched alkyl of 1 to about 30 carbons or cycloalkyl of 3 to about 30 carbons in A, B, and C; linear or branched, alkylaryl or cycloalkylaryl of about 10 to about 30 carbons in A, B and C; $R^4$ is linear or branched alkyl of 4 to about 30 carbons or cycloalkyl of 3 to 30 carbons in A, B, and C; or-linear or branched, alkylaryl or cycloalkylaryl of about 10 to about 30 carbons in A, B, and C; $R^5$ is hydrogen, or linear or branched, alkyl of 1 to about 30 carbons or cycloalkyl of 3 to 30 carbons in A; or linear or branched, alkylaryl or cycloalkylaryl of about 10 to about 30 carbons in A; Z in A is vinylene or arylene or mono or disubstituted vinylene or arylene wherein the mono or di substituents are hydrogen, or linear or branched alkyl of 1 to about 30 carbons or cycloalkyl of 3 to 30 carbons; or-linear or branched aryl, alkylaryl or cycloalkylaryl of about 6 to about 30 carbons, including a divalent heteroatom such as oxygen or sulfur in embodiments of Z.

Examples of BAB and B(AA')B triblock copolymer charge directors containing different generic types of polar A and polar A'blocks include poly[2-ethylhexyl methacrylate (B block)-co-N,N-dimethyl-N-ethyl methacrylate ammonium bromide (A block)-co-2-ethylexyl methacrylate (B block)]-a protonated ammonium BAB triblock copolymer charge director as described herein, poly[2-ethylhexyl methacrylate (B block)-co-N,N,N-trimethyl-N-ethyl methacrylate ammonium bromide (A block)-co-2-ethylhexyl methacrylate (B block)]-an alkylated ammonium BAB triblock copolymer charge director as described in U.S. Ser. No. 314,752 for the corresponding AB diblock copolymer charge directors, poly[2-ethylhexyl methacrylate (B block)-co-N,N-dimethyl-N-methylenecarboxylate-N-ammonium-ethyl methacrylate (A block)-co-2-ethylhexyl methacrylate (B block)]-an alkylated ammonium intra-repeat unit Zwitter ion BAB-triblock copolymer charge director as described in U.S. Pat. No. 5,407,775 for the corresponding AB diblock copolymer charge directors, and poly[2-ethylhexyl methacrylate (B block)-co-N,N,N-trimethyl-2-ammoniumethyl methacrylate (A block-Zl cation)-co-methacrylate (A'block-Zl anion)-co-2-ethylhexyl methacrylate (B block)]-an alkylated ammonium inter-repeat unit Zwitter ion BAB triblock copolymer charge director as described in U.S. Ser. No. 522,908 for the corresponding AB diblock copolymer charge directors. In addition to the above named inter-repeat unit Zwitter ion BAB triblock copolymer charge director, the corresponding free acid and acid salt forms, also described in U.S. Ser. No. 522,908 for the corresponding AB diblock copolymer charge directors, may also comprise the A' block in the B(AA')B triblock copolymer charge directors of this invention.

One preferred ammonium BAB block copolymer charge director of the present invention contains (1) polar A block(s) which contain the positive protonated ammonium nitrogen, and (2) nonpolar B block(s) which have sufficient aliphatic content to enable the block copolymer to more effectively dissolve in the nonpolar liquid with, for example, a Kauri-butanol value of less than about 30, and in embodiments from about 5 to about 30. The total number of blocks in the multiple block copolymer charge directors is at least three. The A block usually possesses a number average molecular weight of from about 200 to about 120,000, and the B block possesses a number average molecular weight range of from about 2,000 to about 190,000 with a Mw to Mn ratio of 1 to 5.

The A block precursor polyamine containing repeat unit is usually prepared from an amine containing monomer which after polymerization is protonated by treatment with the appropriate acid or is alkylated by treatment with the appropriate alkylating agent to form the ammonium A block. Examples of selected A block precursors include polymers prepared from different monomers of 1)$CH_2{=}CRCO_2R^1$ wherein R is hydrogen, or alkyl of 1 to about 20 carbons, aryl of 6 to about 20 carbons, or alkylaryl of 7 to about 20 carbons with or without heteroatoms wherein heteroatoms include oxygen, sulfur, phosphorous, nitrogen, fluorine, chlorine, bromine, iodine, silicon, and the like; and $R^1$ is alkyl of 1 to about 20 carbons where the terminal end of $R^1$ is of the general formula —$N(R^2)_2$, where N is nitrogen, $R^2$ is alkyl of 1 to about 30 carbons or cycloalkyl of 3 to about 30 carbons, aryl of 6 to about 20 carbons or alkylaryl of 7 to about 24 carbons; or 2) 2, 3, or 4-vinylpyridine wherein the ring carbon atoms not substituted with the vinyl group are substituted with $R^2$. Examples of specific monomers selected as A blocks include N,N-dimethylamino-N-2-ethyl methacrylate, N,N-diethylamino-N-2-ethyl methacrylate, N,N-dimethylamino-N-2-ethyl acrylate, N,N-diethylamino-N- 2-ethyl acrylate, N,N-morpholino-N-2-ethyl methacrylate, N,N-morpholino-N-2-ethyl acrylate, 4-vinyl-pyridine, 2-vinyl-pyridine, 3-vinyl pyridine, and the like. B blocks include polymers prepared from one to five different monomers, such as those represented by the general formulas, $CH_2{=}CHR^3$ wherein $R^3$ is as follows excluding hydrogen, $CH_2{=}CR^3CO_2R^4$, wherein $R^3$ is hydrogen or linear or branched alkyl of 1 to 30 carbons, or alkylaryl or cycloalkylaryl of 10 to about 30 carbons and $CH_2{=}CHCO_2R^4$, wherein $R^4$ is linear or branched, alkyl or cycloalkyl of 4 to about 30 carbons; or linear or branched, alkylaryl or cycloalkylaryl of 10 to 30 carbons.

Examples of monomers selected for preparing B blocks in the range of 0.1 to 100 percent include 2-ethylhexylmethacrylate, 2-ethoxyethyl methacrylate, 2-ethylhexyl acrylate, 2-ethoxyethyl acrylate, lauryl methacrylate, lauryl acrylate, cetyl acrylate, cetyl methacrylate, stearyl methacrylate, stearyl acrylate, butadiene, isoprene, methoxybutadiene, isobutylene, cyclohexylethylene, cyclohexenylethylene, myrcene, piperylene, 1-dodecene, 4-tert butylstyrene, 3-tert butylstyrene, cyclooctene, cyclopentene, norbornene, and the like. Optional nonpolar B blocks can be comprised of polymers prepared from at least one monomer selected from the group consisting of $CH_2{=}CHCON(R^4)_2$ and $CH_2{=}CR^3CON(R^4)_2$ where $R^3$ and $R^4$ are as illustrated herein.

Examples of acids in the range of 0.1 to 100 percent that may be selected to convert the amine containing A block precursor to the ammonium A block include acids with a pKa of less than or equal to about 4.5, preferably less than 3.0, and from, for example, 1 to about 3. Acids include hydrobromic acid, hydrochloric acid, hydrofluoric acid, hydroiodic acid, phosphoric acid, sulfuric acid, tetrafluoroboric acid, dichloroacetic acid, difluoroacetic acid, trichloroacetic acid, trifluoroacetic acid, tetrafluoroterephthalic acid, tetrafluorosucciric acid, hexafluoroglutaric acid, hexafluorophosphoric acid, 3-methylsalicylic acid, 5-chlorosalicylic acid, butanesulfonic acid, dodecanesulfonic acid, methanesulfonic acid, trifluoromethanesulfonic acid, p-toluenesulfonic acid, benzenesulfonic acid, dodecylbenzenesulfonic acid, and naphthalene-1,5-disulfonic acid.

Alkylating agents in the amount range of 0.1 to 100 percent that may be selected to convert the amine containing A block precursor to the ammonium A block include methyl p-toluenesulfonate, methyl trifluoromethanesulfonate, ethyl p-toluenesulfonate, methyl bromide, methyl chloride, methyl iodide, butyl bromide, dodecyl chloride, dodecyl iodide, allyl bromide, benzyl bromide, methyl sulfate, methyl hydrogen sulfate, triethyloxonium tetrafluoroborate, trimethyloxonium tetrafluoroborate, trimethyl phosphate and the like.

Alkylating agents in the amount range of 0.1 to 100 percent that may be selected to convert the amine containing A block precursor to an intra-repeat unit zwitterionic ammonium A block include sodium iodoacetate, sodium bromoacetate, lithium iodoacetate, lithium bromoacetate, 1,3-propanesultone, 2,4-butanesultone, 1,4-butanesultone, sodium 2-bromoethanesulfonate, sodium 2-bromoethanesulfinate, sodium 2-bromoethanehydrogen phosphonate, disodium 2-bromoethane phosphonate, sodium 2-bromoethane-P-methyl phosphinate, sodium 2-bromoethane-P-hydrogen phosphinate, pivalolactone, and the like.

Examples of specific monomers selected to become A' block repeat units after polymerization into polar (AA') blocks in inter-repeat unit Zwitter ion containing charge directors include (1) $CH_2{=}CR^7$-$(R^8)$-$CO_2H$, (2) $CH_2{=}CR^7$-$(R^8)$-$SO_3H$, (3) $CH_2{=}CR^7$-$(R^8)$-$PO_3H$, (4) $CH_2{=}CR^7$-$(R^8)AsO_3H$, (5) $CH_2{=}CR^7$-$(R^8)$-$SeO_3H$, (6) $CH_2{=}CR^7$-$(R^8)$-$SO_2H$, (7) $CH_2{=}CR^7$-$(R^8)$-$PHO_2H$, and (8) $CH_2{=}CR^7$-$(R^8)$-

$SiO_3H_2$ wherein $R^7$ is hydrogen, or alkyl of 1 to about 20 carbons, or aryl of 6 to 24 carbons, or alkylaryl of 7 to about 20 carbons with or without heteroatoms wherein heteroatoms include oxygen, sulfur, phosphorous, selenium, arsenic, nitrogen, fluorine, chlorine, bromine, iodine, silicon, and wherein the heteroatoms may be part of a second Bronsted acid group having a pKa of about <7 to > about −4 and $R^8$ is a covalent bond or a covalent bond to an oxygen heteroatom or a covalent bond to a cluster of atoms such as linear or branched alkylene of 1 to about 30 carbons or cycloalkylene of 3 to about 30 carbons, substituted or unsubstituted arylene, alkylarylene or cycloalkylarylene of 6 to about 24 carbons wherein the terminal atom of the cluster may be oxygen or any atoms included in the $R^8$ cluster. Polar A' blocks include repeat unit sequences prepared from monomers containing a vinyl group and at least one acidic functionality or neutralized salt of said acid functionality, which free acid monomers include methacrylic acid, acrylic acid, 4-vinylbenzoic acid, 4-vinyl-1-naphthoic acid, 5-vinyl-2-carboxythiophene, 5-vinyl-2-carboxyfuran, vinylphosphonic acid, 4-vinylbenzenephosphonic acid, vinylphosphinic acid, 4-vinylbenzenesulfinic acid, vinylphosphoric acid, vinylsulfonic acid, 4-vinylbenzenesulfonic acid, vinylsulfinic acid, 4-vinylbenzenearsonic acid, 4-vinylbenzenearsonous acid, 4-vinylphenylselenous acid, 4-vinylphenylselenic acid, 4-vinylphenylsilic acid, 4-vinylphenyl-N-methyl sulfamic acid, 4-vinylphenylsulfurous acid, 4-vinylphenylhydrogen sulfate, 4-vinylphenylhydrogen carbonate, 4-vinylphenylhydrogen sulfite, itaconic acid, and the like.

Inorganic or organic bases having sufficient base strength to neutralize at least one of the acidic hydrogens in the A' block repeat units of the B(AA')B inter-repeat unit Zwitter ion triblock copolymer charge directors can be selected to generate the conjugate acid anion component of the inter-repeat unit Zwitter ion and the neutralized salt of the original acid group. Suitable inorganic bases generally include metal hydrides, methoxides, hydroxides, carbonates, and the like. Suitable hydrides include lithium hydride, sodium hydride, calcium hydride, barium hydride, and zirconium hydride. Suitable methoxides include sodium methoxide, potassium tert. butoxide, aluminum isopropoxide, iron (III) methoxide, and manganese (II) methoxide. Suitable hydroxides include lithium hydroxide, sodium hydroxide, and potassium hydroxide. Suitable carbonates include sodium carbonate and sodium hydrogen carbonate. Suitable strong organic bases include (1) trialkyl amines such as triethylamine, triisopropylamine, tributylamine, 1,4-diazabicyclo[2.2.2-]octane, quinuclidine, and 1,8-bis-(dimethylamino)-naphthalene; (2) cyclic amidines such as 1,5-diazabicyclo[4.3.0]non-5-ene and 1,8-diazabicyclo[5.4.0]undec-7-ene; (3) and organic ammonium hydroxides such as tetrabutylammonium hydroxide and benzyltrimethylammonium hydroxide.

In embodiments, the ammonium triblock copolymer can be prepared by the polymerization of ammonium A block monomers with the nonpolar B block monomers.

Examples of ammonium triblock BAB copolymers selected in the range of 0.1 to 100 percent (nonpolar B block named first then polar A block, then nonpolar B block) wherein 2-ethylhexyl acrylate can be substituted for 2-ethylhexyl methacrylate and N,N-dimethyl-N-ethyl acrylate ammonium anion can be substituted for N,N-dimethyl-N-ethyl methacrylate ammonium anion include poly[2-ethylhexyl methacrylate (B block)-co-N,N-dimethyl-N-ethyl methacrylate ammonium bromide (A block)-co-2-ethylhexyl methacrylate (B block)], poly[2-ethylhexyl methacrylate (B block)-co-N,N-dimethyl-N-ethyl methacrylate ammonium tosylate (A block)-co-2-ethylhexyl methacrylate (B block)], poly[2-ethylhexyl methacrylate (B block)-co-N,N-dimethyl-N-ethyl methacrylate ammonium chloride (A block)-co-2-ethylhexyl methacrylate (B block)], poly[N,N-dibutyl methacrylamide (B block)-co-N,N-dimethyl-N-ethyl methacrylate ammonium bromide (A block)-co-N,N-dibutyl methacrylamide (B block)], poly[N,N-dibutyl methacrylamide (B block)-co-N,N-dimethyl-N-ethyl methacrylate ammonium tosylate (A block)-co-N,N-dibutyl methacrylamide (B block)], poly[N,N-dibutyl acrylamide (B block)-co-N,N-dimethyl-N-ethyl methacrylate ammonium bromide (A block)-co-N,N-dibutyl acrylamide (B block)], poly[N,N-dibutyl acrylamide (B block)-co-N,N-dimethyl-N-ethyl methacrylate ammonium tosylate (A block)-co-N,N-dibutyl acrylamide (B block)], poly[2-ethylhexyl methacrylate (B block)-co-4-vinyl-N,N-dimethylanilinium bromide (A block)-co-2-ethylhexyl methacrylate (B block)], poly[2-ethylhexyl methacrylate (B block)-co-4-vinyl-N,N-dimethylanilinium tosylate (A block)-co-2-ethylhexyl methacrylate (B block)], and poly[2-ethylhexyl methacrylate (B block)-co-ethylene-N-methyl ammonium bromide (A block)-co-2-ethylhexyl methacrylate (B block)].

Examples of BAB block copolymer charge directors containing quaternary ammonium intra-repeat unit zwitter ions (nonpolar B block named first, then polar A block, then nonpolar B block) in the range of 0.1 to 100 percent wherein 2-ethylhexyl acrylate can be substituted for 2-ethylhexyl methacrylate and N,N-dimethyl-N-ethyl acrylate ammonium anion can be substituted for N,N-dimethyl-N-ethyl methacrylate ammonium anion include poly[2-ethylhexyl methacrylate (B block)-co-N,N-dimethyl-N-methylenecarboxylate-N-ammoniumethyl methacrylate (A block)-co-2-ethylhexyl methacrylate (B block)], poly[2-ethylhexyl methacrylate (B block)-co-N,N-dimethyl-N-propylenesulfonate-N-ammoniumethyl methacrylate (A block)-co-2-ethylhexyl methacrylate (B block)], poly[2-ethylhexyl methacrylate (B block)-co-N,N-dimethyl-N-propylenephosphonate-N-ammoniumethyl methacrylate (A block)-co-2-ethylhexyl methacrylate (B block)], poly[2-ethylhexyl methacrylate (B block)-co-N,N-dimethyl-N-propylenephosphinate-N-ammoniumethyl methacrylate (A block)-co-2-ethylhexyl methacrylate (B block)], poly[2-ethylhexyl methacrylate (B block)-co-N,N-dimethyl-N-propylenesulfinate-N-ammoniumethyl methacrylate (A block)-co-2-ethylhexyl methacrylate (B block)], poly[2-ethylhexyl methacrylate (B block)-co-N,N-dimethyl-N-butylenecarboxylate-N-ammoniumethyl methacrylate (A block)-co-2-ethylhexyl methacrylate (B block)], poly[2-ethylhexyl methacrylate (B block)-co-N,N-dimethyl-N-ethyleneoxyethylenecarboxylate-N-ammoniumethyl methacrylate (A block)-co-2-ethylhexyl methacrylate (B block)], poly[2-ethylhexyl methacrylate (B block)-co-N,N-dimethyl-N-ethyleneoxyethylenesulfonate-N-ammoniumethyl methacrylate (A block)-co-2-ethylhexyl methacrylate (B block)], poly[N,N-dibutyl methacrylamido (B block)-co-N,N-dimethyl-N-methylenecarboxylate-N-ammoniumethyl methacrylate (A block)-co-N,N-dibutyl methacrylamido (B block)], poly[N,N-dibutyl methacrylamido (B block)-co-N,N-dimethyl-N-propylenesulfonate-N-ammoniumethyl methacrylate (A block)-co-N,N-dibutyl methacrylamido (B block)], poly[N,N-dibutyl methacrylamido (B block)-co-N,N-dimethyl-N-propylenephosphonate-N-ammoniumethyl methacrylate (A block)-co-N,N-dibutylmethacrylamido (B block)], poly[N,N-dibutyl methacrylamido (B block)-co-N,N-dimethyl-N-propylenephosphinate-N-ammoniumethyl methacrylate (A block)-co-N,N-dibutylmethacrylamido (B block)], and poly(N,N-dibutyl methacrylamido (B block)- co-N,N-dimethyl-N-propylenesulfinate-N-ammoniumethyl methacrylate (A block)-co-N,N-dibutylmethacrylamido (B block)]. Additional suitable examples of nonpolar liquid soluble multiple block intra-repeat unit zwitterionic ammonium copolymer charge directors (nonpolar B block named first then polar A block and then nonpolar B block) include poly[2-ethylhexyl methacrylate (B block)-co-4-vinylpyridinium-N-methylenecarboxylate (A block)-co-2-ethylhexyl methacrylate (B block)], poly[2-ethylhexyl methacrylate (B block)-co-4-vinylpyridinium-N-propylenesulfonate (A block)-co-2-ethylhexyl methacrylate (B block)], poly[2-ethylhexyl methacrylate (B block)-co-4-vinylpyridinium-N-propylenephosphonate (A block)-co-2-ethylhexyl methacrylate (B block)], poly[2-ethylhexyl methacrylate (B block)-co-4-vinylpyridinium-N-propylenephosphinate (A block)-co-2-ethylhexyl methacrylate (B block)], poly[2-ethylhexyl methacrylate (B block)-co-4-vinylpyridinium-N-propylenesulfinate (A block)-co-2-ethylhexyl methacrylate (B block)], poly[2-ethylhexyl methacrylate (B block)-co-4-vinylpyridinium-N-ethyleneoxyethylenecarboxylate (A block)-co-2-ethylhexyl methacrylate (B block)], poly[2-ethylhexyl methacrylate (B block)-co-4-vinylpyridinium-N-ethyleneoxyethylenesulfonate (A block)-co-2-ethylhexyl methacrylate (B block)], poly[4-vinylpyridinium-N-ethyleneoxyethylenephosphonate (A block)-co-2-ethylhexyl methacrylate (B block), poly[4-vinylpyridinium-N-methylenecarboxylate-co-p-tertiary butylstyrene), and the like.

Examples of B(AA')B triblock copolymer charge directors containing quaternary ammonium inter-repeat unit zwitter ions (nonpolar B block named first, then polar A block, then polar A' block and finally nonpolar B block) in the range of 0.1 to 100 percent wherein 2-ethylhexyl acrylate can be substituted for 2-ethylhexyl methacrylate, and the Zwitter ion cation component, N,N-dimethyl-N-ammoniumethyl acrylate, can be substituted for the Zwitter ion cation component, N,N-dimethyl-N-ammoniumethyl methacrylate, and the 2 and 3-vinylpyridinium isomers can be substituted for the 4-vinylpyridinium isomer include poly[2-ethylhexyl methacrylate (B block)-co-N,N,N-trimethylammoniumethyl methacrylate (A block-Zl cation)/methacrylate (A' block-Zl anion)-co-2-ethylhexyl methacrylate (B block)], poly[2-ethylhexyl methacrylate (B block)-co-N,N,N-trimethylammoniumethyl methacrylate (A block-Zl cation)/4-vinylbenzoate (A' block-Zl anion)-co-2-ethylhexyl methacrylate (B block)], poly[2-ethylhexyl methacrylate (B block)-co-N,N,N-trimethylammoniumethyl methacrylate (A block-Zl cation)/4-vinylbenzenesulfonate (A' block-Zl anion)-co-2-ethylhexyl methacrylate (B block)], poly[2-ethylhexyl methacrylate (B block)-co-N,N,N-trimethylammoniumethyl methacrylate (A block-Zl cation)/4-vinylbenzenesulfinate (A' block-Zl anion)-co-2-ethylhexyl methacrylate (B block)], poly[2-ethylhexyl methacrylate (B block)-co-N,N,N-trimethylammoniumethyl methacrylate (A block-Zl cation)/4-vinylbenzenephosphonate (A' block-Zl anion)-co-2-ethylhexyl methacrylate (B block)], poly[2-ethylhexyl methacrylate (B block)-co-N,N,N-trimethylammoniumethyl methacrylate (A block-Zl cation)/4-vinylbenzenearsonate (A' block-Zl anion)-co-2-ethylhexyl methacrylate (B block)], poly[2-ethylhexyl methacrylate (B block)-co-N,N,N-trimethylammoniumethyl methacrylate (A block-Zl cation)/4-vinylbenzeneselenate (A' block-Zl anion)-co-2-ethylhexyl methacrylate (B block)], poly[2-ethylhexyl methacrylate (B block)-co-N,N,N-trimethylammoniumethyl methacrylate (A block-Zl cation)/itaconate (A' block-Zl anion)-co-2-ethylhexyl methacrylate (B block)], poly[N,N-dibutylmethacrylamide (B block)-co-N,N,N-trimethylammoniumethyl methacrylate (A block-Zl cation)/methacrylate (A' block-Zl anion)-co-2-ethylhexyl methacrylate (B block)], poly[N,N-dibutylmethacrylamide (B block)-co-N,N,N-trimethylammoniumethyl methacrylate (A block-Zl cation)/4-vinylbenzene carboxylate (A' block-Zl anion)-co-N,N-dibutylmethacrylamide (B block)], poly[N,N-dibutylmethacrylamide (B block)-co-N,N,N-trimethylammoniumethyl methacrylate (A block-Zl cation)/itaconate (A' block-Zl anion)-co-2-ethylhexyl methacrylate (B block)], poly[N,N-dibutylmethacrylamide (B block)-co-N,N,N-trimethylammoniumethyl methacrylate (A block-Zl cation)/4-vinylbenzenesulfonate (A' block-Zl anion)-co-N,N-dibutylmethacrylamide (B block)], poly[N,N-dibutylmethacrylamide (B block)-co-N,N,N-trimethylammoniumethyl methacrylate (A block-Zl cation)/4-vinylbenzenephosphonate (A' block-Zl anion)-co-2-ethylhexyl methacrylate (B block)], poly[N,N-dibutylmethacrylamide (B block)-co-N,N,N-trimethylammoniumethyl methacrylate (A block-Zl cation)/4-vinylbenzenephosphinate (A' block-Zl anion)-co-N,N-dibutylmethacrylamide (B block)], poly[2-ethylhexyl methacrylate (B block)-co-4-vinyl-N-methylpyridinium (A block-Zl cation)-co-methacrylate (A' block-Zl anion)-co-2-ethylhexyl methacrylate (B block)], poly[2-ethylhexyl methacrylate (B block)-co-4-vinyl-N-methylpyridinium (A block-Zl cation)-co-itaconate (A' block-Zl anion)-co-2-ethylhexyl methacrylate (B block)], poly[2-ethylhexyl methacrylate (B block)-co-4-vinyl-N-methylpyridinium (A block-Zl cation)-co-4-vinylbenzenesulfonate (A' block-Zl anion)-co-2-ethylhexyl methacrylate (B block)], poly[2-ethylhexyl methacrylate (B block)-co-4-vinyl-N-methylpyridinium (A block-Zl cation)-co-4-vinylbenzenephosphonate (A' block-Zl anion)-co-2-ethylhexyl methacrylate (B block)], poly[2-ethylhexyl methacrylate (B block)-co-4-vinyl-N-methylpyridinium (A block-Zl cation)-co-4-vinylbenzenephosphinate (A' block-Zl anion)-co-2-ethylhexyl methacrylate (B block)], poly[2-ethylhexyl methacrylate (B block)-co-4-vinyl-N-methylpyridinium (A block-Zl cation)-co-methacrylate (A' block-Zl anion)-co-p-tertiary butylstyrene (B block)], and the like.

The BAB charge director can be selected for the liquid developers in various effective amounts, such as for example from about 0.5 percent to 100 percent by weight relative to developer solids and preferably 2 percent to 20 percent by weight relative to developer solids. Developer solids include toner resin, pigment, and optional charge adjuvant. Without pigment, the developer may be selected for the generation of a resist, or a printing plate, and the like.

Examples of liquid carriers or vehicles selected for the developers of the present invention include a liquid with viscosity of from about 0.5 to about 500 centipoise, and preferably from about 1 to about 20 centipoise, and a resistivity greater than or equal to $5\times10^9$ ohm/centimeters, such as $10^{13}$ ohm/centimeters, or more. Preferably, the liquid selected in embodiments is a branched chain aliphatic hydrocarbon. A nonpolar liquid of the ISOPAR® series available from Exxon Corporation may also be used for the developers of the present invention. These hydrocarbon liquids are considered narrow portions of isoparaffinic hydrocarbon fractions with extremely high levels of purity. For example, the boiling range of ISOPAR G® is between about 157° C. and about 176° C.; ISOPAR H® is between about 176° C. and about 191° C.; ISOPAR K® is between about 177° C. and about 197° C.; ISOPAR L® is between about 188° C. and about 206° C.; ISOPAR M® is between about 207° C. and about 254° C.; and ISOPAR V® is between about 254.4° C. and about 329.4° C. ISOPAR L® has a mid-boiling point of approximately 194° C. ISOPAR M® has an auto ignition temperature of 338° C. ISOPAR G® has a flash point of 40° C. as determined by the tag closed cup method; ISOPAR H® has a flash point of 53° C. as determined by the ASTM D-56 method; ISOPAR L® has a flash point of 61° C. as determined by the ASTM D-56 method; and ISOPAR M® has a flash point of 80° C. as determined by the ASTM D-56 method. The liquids selected are known and should have an electrical volume resistivity in excess of $10^9$ ohmcentimeters and a dielectric constant below or equal to 3.0. Moreover, the vapor pressure at 25° C. should be less than or equal to 10 Torr in embodiments.

While the ISOPAR® series liquids are the preferred nonpolar liquids in embodiments for use as dispersants in the liquid developers of the present invention, the important characteristics of viscosity and resistivity can be achieved, it is believed, with other suitable liquids. Specifically, the NORPAR® series available from Exxon Corporation, the SOLTROL® series available from the Phillips Petroleum Company, and the SHELLSOL® series available from the Shell Oil Company can be selected.

The amount of the liquid employed in the developer of the present invention is from about 90 to about 99.9 percent, and preferably from about 95 to about 99 percent by weight of the total developer dispersion. The total solids content of the developers is, for example, 0.1 to 10 percent by weight, preferably 0.3 to 3 percent, and more preferably 0.5 to 2.0 percent by weight.

Various suitable thermoplastic toner resins can be selected for the liquid developers of the present invention in effective amounts of, for example, in the range of 99 percent to 40 percent of developer solids, and preferably 95 percent to 70 percent of developer solids; developer solids includes the thermoplastic resin, optional pigment and charge control agent and any other component that comprises the particles. Examples of such resins include ethylene vinyl acetate (EVA) copolymers (ELVAX® resins, E. I. DuPont de Nemours and Company, Wilmington, Del.); copolymers of ethylene and an α-β-ethylenically unsaturated acid selected from the group consisting of acrylic acid and methacrylic acid; copolymers of ethylene (80 to 99.9 percent), acrylic or methacrylic acid (20 to 0.1 percent)/alkyl ($C_1$ to $C_5$) ester of methacrylic or acrylic acid (0.1 to 20 percent); polyethylene; polystyrene; isotactic polypropylene (crystalline); ethylene ethyl acrylate series available as BAKELITE® DPD 6169, DPDA 6182 Natural (Union Carbide Corporation); ethylene vinyl acetate resins, for example DQDA 6832 Natural 7 (Union Carbide Corporation); SURLYN® ionomer resin (E. I. DuPont de Nemours and Company); or blends thereof; polyesters; polyvinyl toluene; polyamides; styrene/butadiene copolymers; epoxy resins; acrylic resins, such as a copolymer of acrylic or methacrylic acid, and at least one alkyl ester of acrylic or methacrylic acid wherein alkyl is from 1 to about 20 carbon atoms like methyl methacrylate (50 to 90 percent)/methacrylic acid (0 to 20 percent/ethylhexyl acrylate (10 to 50 percent); and other acrylic resins including ELVACITE® acrylic resins (E. I. DuPont de Nemours and Company); or blends thereof. Preferred copolymers are the copolymer of ethylene and an α-β-ethylenically unsaturated acid of either acrylic acid or methacrylic acid. In a preferred embodiment, NUCREL® like NUCREL® 599, NUCREL® 699, or NUCREL® 960 can be selected as the thermoplastic resin.

The liquid developers of the present invention may optionally contain a colorant dispersed in the resin particles. Colorants, such as pigments or dyes and mixtures thereof, are preferably present to render the latent image visible.

The colorant may be present in the resin particles in an effective amount of, for example, from about 0.1 to about 60 percent, and preferably from about 1 to about 30 percent by weight based on the total weight of solids contained in the developer. The amount of colorant used may vary depending on the use of the developer. Examples of colorants include pigments like carbon blacks like REGAL 330®, cyan, magenta, yellow, blue, green, brown and mixtures thereof; pigments as illustrated in U.S. Pat. No. 5,223,368, and U.S. Pat. No. 5,484,679, the disclosures of which are totally incorporated herein by reference.

To increase the toner particle charge and, accordingly, increase the mobility and transfer latitude of the toner particles, charge adjuvants can be added to the toner. For example, adjuvants, such as metallic soaps like aluminum, magnesium stearate or octoate, fine particle size oxides, such as oxides of silica, alumina, titania, and the like, paratoluene sulfonic acid, and polyphosphoric acid, may be added. Negative charge adjuvants primarily increase the negative charge or decrease the positive charge of the toner particle, while the positive charge adjuvants increase the positive charge of the toner particles. With the invention of the present application, in embodiments the adjuvants or charge additives can be comprised of the metal catechol and aluminum hydroxy acid complexes illustrated in U.S. Pat. No. 5,306,591 and U.S. Pat. No. 5,308,731, the disclosures of which are totally incorporated herein by reference, and which additives in combination with the charge directors of the present invention have, for example, the following advantages over the aforementioned prior art charge additives: improved toner charging characteristics, namely, an increase in particle charge, as measured by ESA mobility, from −1.4 E-10 $m^2/Vs$ to −2.3 E-10 $m^2/Vs$, that results in improved image development and transfer, from 80 percent to 93 percent, to allow improved solid area coverage, and a transferred image reflectance density of 1.2 to 1.3. The adjuvants can be added to the toner particles in an amount of from about 0.1 percent to about 15 percent of the total developer solids and preferably from about 1 percent to about 5 percent of the total weight of solids contained in the developer.

The charge on the toner particles alone may be measured in terms of particle mobility using a high field measurement device. Particle mobility is a measure of the velocity of a toner particle in a liquid developer divided by the size of the electric field within which the liquid developer is employed. The greater the charge on a toner particle, the faster it moves through the electrical field of the development zone. The movement of the particle is required for image development and background cleaning.

Toner particle mobility can be measured using the electroacoustics effect, the application of an electric field, and the measurement of sound, reference U.S. Pat. No. 4,497,208, the disclosure of which is totally incorporated herein by reference. This technique is particularly useful for nonaqueous dispersions because the measurements can be made at high volume loadings, for example greater than or equal to 1.5 to 10 weight percent. Measurements made by this technique have been shown to correlate with image quality, for example high mobilities can lead to improved image density, resolution and improved transfer efficiency. Residual conductivity, that is the conductivity from the charge director, is measured using a low field device as illustrated in the following Examples.

The liquid electrostatic developer of the present invention can be prepared by a variety of known processes such as, for example, mixing in a nonpolar liquid the thermoplastic resin and colorant in a manner that the resulting mixture contains, for example, about 15 to about 30 percent by weight of solids; heating the mixture to a temperature of from about 70° C. to about 130° C. until a uniform dispersion is formed; adding an additional amount of nonpolar liquid sufficient to decrease the total solids concentration of the developer to about 10 to 20 percent by weight; cooling the dispersion to about 10° C. to about 50° C.; adding a charge adjuvant compound to the dispersion; and diluting the dispersion, followed by mixing with the charge director.

In the initial mixture, the resin, colorant and charge adjuvant may be added separately to an appropriate vessel such as, for example, an attritor, heated ball mill, heated vibratory mill, such as a Sweco Mill manufactured by Sweco Company, Los Angeles, Calif., equipped with particulate media for dispersing and grinding, a Ross double planetary mixer (manufactured by Charles Ross and Son, Hauppauge, N.Y.), or a two roll heated mill, which requires no particulate media. The charge director can be added at any point in the toner preparation, but is preferably added after the particles have been reduced to their desired size. Useful particulate media include particulate materials like a spherical cylinder selected from the group consisting of stainless steel, carbon steel, alumina, ceramic, zirconia, silica and sillimanite. Carbon steel particulate media are particularly useful when colorants other than black are used. A typical diameter range for the particulate media is in the range of 0.04 to 0.5 inch (approximately 1.0 to approximately 13 millimeters).

Sufficient nonpolar liquid is added to provide a dispersion of from about 15 to about 50 percent solids. This mixture is subjected to elevated temperatures during the initial mixing procedure to plasticize and soften the resin. The mixture is sufficiently heated to provide a uniform dispersion of all solid materials, that is colorant, adjuvant and resin. The temperature at which this step is undertaken should not be so high as to degrade the nonpolar liquid or decompose the resin or colorant when present. Accordingly, the mixture is heated to a temperature of from about 70° C. to about 130° C., and preferably to about 75° C. to about 110° C. The mixture may be ground in a heated ball mill or heated attritor at this temperature for about 15 minutes to 5 hours, and preferably about 60 to about 180 minutes.

After grinding at the above temperatures, an additional amount of nonpolar liquid may be added to the dispersion. The amount of nonpolar liquid to be added at this point should be an amount sufficient to decrease the total solids wherein solids include resin, charge adjuvant, and pigment concentration of the dispersion to from about 10 to about 20 percent by weight.

The dispersion is then cooled to about 10° C. to about 50° C., and preferably to about 15° C. to about 30° C., while mixing is continued until the resin admixture solidifies or hardens. Upon cooling, the resin admixture precipitates out of the dispersant liquid. Cooling is accomplished by methods such as the use of a cooling fluid, such as water, ethylene glycol, and the like in a jacket surrounding the mixing vessel. Cooling may be accomplished, for example, in the same vessel, such as the attritor, while simultaneously grinding with particulate media to prevent the formation of a gel or solid mass; without stirring to form a gel or solid mass, followed by shredding the gel or solid mass and grinding by means of particulate media; or with stirring to form a viscous mixture and grinding by means of particulate media. The resin precipitate is cold ground for about 1 to 36 hours, and preferably 2 to 6 hours. Additional liquid may be added at any step during the preparation of the liquid developer to facilitate grinding or to dilute the developer to the appropriate percent solids needed for developing. Methods for the preparation of developers that can be selected are illustrated in U.S. Pat. Nos. 4,760,009; 5,017,451; 4,923,778 and 4,783,389, the disclosures of which are totally incorporated herein by reference.

Methods of imaging are also encompassed by the present invention wherein after formation of a latent image on a photoconductive imaging member, reference U.S. Pat. No. 5,306,591, the disclosure of which is totally incorporated herein by reference, the image is developed with the liquid toner illustrated herein by, for example, immersion of the photoconductor therein, followed by transfer and fixing of the image, or transfer to an intermediate belt, a second transfer to a substrate like paper, followed by fixing.

The present invention is illustrated in the following non-limiting Examples, it being understood that these Examples are intended to be illustrative only and that the invention is not intended to be limited to the materials, conditions, process parameters and the like recited herein. All parts and percentages are by weight unless otherwise indicated. Control Examples are also provided. The conductivity of the liquid toner dispersions and charge director solutions were determined with a Scientifica 627 Conductivity Meter (Scientifica, Princeton, N.J.). The measurement signal for this meter is a low distortion 18 hz sine wave with an amplitude of 5.4 to 5.8 volts rms. Toner particle mobilities and zeta potentials were determined with a MBS-8000 electrokinetic sonic analysis (ESA) system (Matec Applied Science, Hopkinton, Ma.). The system was calibrated in the aqueous mode per manufacturer's recommendation to give an ESA signal corresponding to a zeta potential of −26 millivolts for a 10 percent (v/v) suspension of LUDOX™ (DuPont). The system was then set up for nonaqueous measurements. The toner particle mobility is dependent on a number of factors including particle charge and particle size. The ESA system also calculates the zeta potential which is directly proportional to toner charge and is independent of particle size. Particle size was measured by the Horiba CAPA-500 and 700 centrifugal automatic particle analyzer, manufactured by Horiba Instruments, Inc., Irvine, Calif.

EXAMPLE I

YELLOW LIQUID TONER PREPARATION 1 [26643-75]

163.6 Grams of NUCREL 599®, a copolymer of ethylene and methacrylic acid with a melt index at 190° C. of 500 dg/minute, available from E. I. DuPont de Nemours & Company, Wilmington, Del., 56.8 grams of the pigment Paliotol Yellow D1155, 6.8 grams of the charge adjuvant aluminum stearate WITCO 22™ and 307.4 grams of NORPAR 15™, available from Exxon Corporation, were added to a Union Process 1 S attritor (Union Process Company, Akron, Ohio) charged with 0.1875 inch (4.76 millimeters) diameter carbon steel balls. The mixture was milled in the attritor which was heated with running steam through the attritor jacket at 84° to 93° C. for 2 hours. An additional 980.1 grams of NORPAR 15™ were added and the attritor contents were cooled to 22° C. by running cold water through the attritor jacket while cold grinding for an additional 4.5 hours. An additional 1,517 grams of NORPAR 15™ were added and the mixture was separated by the use of a metal grate from the steel balls yielding a liquid toner concentrate of 7.34 percent solids wherein solids include resin, charge adjuvant, and pigment and 92.66 percent of NORPAR 15™. The particle diameter was 2.47 microns average by volume as measured with a Horiba Cappa 700. This yellow liquid toner concentrate was used to prepare 1 percent liquid toners or developers in Controls 1A, 1B, 1C and in Examples VIA, VIB, and VIC.

EXAMPLE II

AB DIBLOCK BASE POLYMER PREPARATION 1: [SP$^2$-125-69-1]

Sequential Group Transfer Polymerization (GTP) of 2-ethylhexyl methacrylate (EHMA) and 2-dimethylaminoethyl methacrylate (DMAEMA) to prepare the AB diblock base copolymer precursor, poly[2-ethylhexyl methacrylate (B block)-co-N,N-dimethylamino-N-ethyl methacrylate (A block)] of the protonareal ammonium bromide AB diblock copolymer charge director was accomplished as follows.

The AB diblock copolymer precursor was prepared by a standard sequential group transfer polymerization procedure (GTP) wherein the 2-dimethylaminoethyl methacrylate monomer was first polymerized to completion, and then the 2-ethylhexyl methacrylate monomer was polymerized onto the living end of the dimethylaminoethyl methacrylate polymer. All glassware was first baked out in an air convection oven at about 120° C. for about 16 to 18 hours.

A 250 milliliter 3-neck round bottom flask equipped with a magnetic stirring football, a thermometer, an Argon inlet and outlet, and a neutral alumina (30 grams) column (exchangeable with a rubber septum) was charged through the alumina column, which is maintained under a positive Argon flow and sealed from the atmosphere, with 90.0 grams (0.5725 mole) of freshly distilled 2-dimethylaminoethyl methacrylate (DMAEMA) (the A monomer). Subsequently, 80 milliliters of freshly distilled tetrahydrofuran solvent, distilled from sodium benzophenone, was rinsed through the same alumina column into the polymerization flask. Thereafter, as the GTP initiator, 1.1 milliliters of methyl trimethylsilyl dimethylketene acetal (0.944 gram; 0.00541 mole) was syringed into the polymerization vessel. The acetal was originally vacuum distilled and a middle fraction was collected and stored (under Argon) for polymerization initiation purposes. After stirring for about 5 minutes at ambient temperature under a gentle Argon flow, 0.3 milliliter of a 0.033 molar solution of tetrabutylammonium acetate (catalyst) in the same dry tetrahydrofuran was also syringed into the polymerization vessel. The contents of the polymerization vessel exothermed from 25° C. to about 90° C. and after the exotherm peaked, the temperature dropped back to about 25° C. Shortly thereafter, the contents of the 250 milliliter reactor were syringe transferred to a similarly equipped 2 liter reactor containing 415.0 grams (2.093 mole) of freshly distilled 2-ethylhexyl methacrylate (EHMA) (the B monomer) in 500 milliliters of THF. The EHMA was added to the 2 liter reactor by first passing the monomer through a column containing 150 grams of neutral alumina followed by a column rinse with the 500 milliliter of THF. Another 0.5 milliliter of 0.033M tetrabutyl ammonium acetate catalyst was syringed into the 2 liter reaction vessel resulting in a slow but steady exotherm from 25° to 55° C. After stirring for an additional 17 hours at ambient temperature, 10 milliliters of methanol were added to the reaction vessel to quench the live ends of the diblock copolymer. After stirring for another hour at ambient temperature, the contents of the reaction vessel were rotoevaporated to dryness at 50° to 60° C. and 40 to 50 millimeters Hg for about 1 hour, and then toluene was added to the solid residue to give a toluene solution containing 44.51 weight percent AB diblock copolymer solids.

The above charges of initiator and monomers provide an $M_n$ and average degree of polymerization (DP) for each block. For the DMAEMA polar A block, the charged $M_n$ was 16,623 and the average DP was 105.7. For the EHMA nonpolar B block, the charged $M_n$ was 76,650 and the average DP was 386.5. The total charged molecular weight ($M_n$) was 93,273.

A small (3 to 4 grams) portion of the AB diblock copolymer was isolated for GPC analysis and $^1$H-NMR analysis by rotoevaporating the bulk of the toluene solvent from a 6 to 8 gram sample of the 44.51 percent toluene solution prepared above. The solid copolymer was then dried overnight (16 to 17 hours) in vacuo (about 0.5 Torr) at about 50° C. GPC analysis was obtained on a portion of the 3 to 4 gram sample of isolated solid polymer using four (100A, 500A, 1,000A, and 10,000 Angstroms) WATERS ULTRASTYRAGEL™ columns in series onto which was injected a 50 microliter sample of this AB diblock copolymer at 0.2 percent (weight/volume) in THF. The sample on the GPC column was then eluted with THF at a flow rate of 1 milliliter/minute, and the chromatogram was detected with a Waters 410 differential refractometer. The polystyrene equivalent number average molecular weight was found to be 50,700 and the weight average molecular weight was 106,200 providing a MWD of 2.10. $^1$H-NMR analysis was obtained on a fraction of a 1 to 2 gram sample of this AB diblock base copolymer solid isolated by rotoevaporating the toluene solvent at the same rotoevaporation conditions described above. $^1$H-NMR analysis of a 10.0 percent (g/dl) $CDCl_3$ solution of the copolymer indicated 77.8 mole percent (81.55 weight percent) EHMA and 22.2 mole percent (18.45 weight percent) DMAEMA. The AB diblock copolymer, poly[2-ethylhexyl methacrylate (B block)-co-N,N-dimethylamino-N-ethyl methacrylate (A block)], prepared in this Example was used to prepare the charge director in Example IV.

EXAMPLE III

BAB TRIBLOCK BASE POLYMER PREPARATION 2 [SP$^2$-125-84-1]

Sequential Group Transfer Polymerization (GTP) of 2-ethylhexyl methacrylate (EHMA), 2-dimethylaminoethyl methacrylate (DMAEMA), and finally 2-ethylhexyl methacrylate (EHMA) to prepare the BAB triblock base copolymer precursor, poly[2-ethylhexyl methacrylate (B block)-co-N,N-dimethylamino-N-ethyl methacrylate (A block)]of the protonated ammonium bromide BAB triblock copolymer charge director was accomplished as follows.

The BAB triblock copolymer precursor was prepared by a standard sequential group transfer polymerization procedure (GTP) wherein the 2-ethylhexyl methacrylate was first polymerized to completion, and then the 2-dimethylaminoethyl methacrylate monomer was polymerized onto the living end of the 2-ethylhexyl methacrylate polymer, and finally, a second block of 2-ethylhexyl methacrylate monomer was polymerized onto the living end of the 2-ethylhexyl methacrylate-co-dimethylaminoethyl methacrylate copolymer. All glassware was first baked out in an air convection oven at about 120° C. for about 16 to 18 hours.

A 250 milliliter 3-neck round bottom flask equipped with a magnetic stirring football, a thermometer, an Argon inlet and outlet, and a neutral alumina (10 grams) column (exchangeable with a rubber septum) was charged through the alumina column, which is maintained under a positive Argon flow, and sealed from the atmosphere with 20.75 grams (0.1046 mole) of freshly distilled 2-ethylhexyl methacrylate monomer (EHMA) (to prepare the first B block). Subsequently, 50 milliliters of freshly distilled tetrahydrofuran solvent, distilled from sodium benzophenone, were rinsed through the same alumina column into the polymerization flask. Subsequently, the GTP initiator, 0.11 milliliter of methyl trimethylsilyl dimethylketene acetal (0.0944 gram; 0.000541 mole), was syringed into the polymerization vessel. The acetal was originally vacuum distilled and a middle fraction was collected and stored (under Argon) for polymerization initiation purposes. After stirring for about 5 minutes at ambient temperature under a gentle Argon flow, 0.05 milliliter of a 0.033 molar solution of tetrabutylammonium acetate (catalyst) in the same dry tetrahydrofuran was also syringed into the polymerization vessel. The contents of the polymerization vessel reached peak exotherm after about 1.0 hour. Shortly thereafter, 9.0 grams (0.0572 mole) of freshly distilled 2-dimethylaminoethyl methacrylate (DMAEMA) monomer (to prepare the A block) were added to the polymerization vessel through a small (10 grams) dry alumina column which was subsequently rinsed with 6 milliliters of anhydrous THF. A small exotherm was noted and about 15 minutes after the exotherm peaked another 20.75 grams (0.1046 mole) of freshly distilled 2-ethylhexyl methacrylate monomer (to prepare the second B block) were passed through a second small (6 grams) dry alumina column into the reaction vessel. The column was finally rinsed with 50 milliliters of anhydrous THF. After stirring for 17 hours at ambient temperature, 2 milliliters of methanol were added to the reaction vessel to quench the live ends of the triblock copolymer. After stirring for another hour at ambient temperature, the contents of the reaction vessel were rotoevaporated to dryness at 50° to 60° C. and 40 to 50 millimeters Hg for about 1 hour and then toluene was added to the solid residue to give a toluene solution containing 43.79 weight percent BAB triblock copolymer solids.

The above charges of initiator and monomers provided an $M_n$ and average degree of polymerization (DP) for each block. For the EHMA nonpolar B blocks, the charged $M_n$ was 38,325 and the average DP was 193.3. For the DMAEMA polar A block, the charged $M_n$ was 16,623 and the average DP was 105.7. The total charged molecular weight ($M_n$) was 93,273.

A small (3 to 4 grams) portion of the BAB triblock copolymer was isolated for GPC analysis and nonaqueous titration by rotoevaporating the bulk of the toluene solvent from a 6 to 8 gram sample of the 43.79 percent toluene solution prepared above. The solid copolymer was then dried overnight (16 to 17 hours) in vacuo (about 0.5 Torr) at about 50° C. GPC analysis was obtained on a portion of the 3 to 4 gram sample of isolated solid polymer using four (100A, 500A, 1,000A, and 10,000 Angstroms) WATERS ULTRASTYRAGEL™ columns in series onto which was injected a 50 microliter sample of this BAB triblock copolymer at 0.2 percent (weight/volume) in THF. The sample on the GPC column was then eluted with THF at a flow rate of 1 milliliter/minute, and the chromatogram was detected with a Waters 410 differential refractometer. The polystyrene equivalent number average molecular weight was found to be 52,040 and the weight average molecular weight was 73,020 giving a MWD of 1.40. A nonaqueous titration was performed on a 1 gram sample of the dried BAB triblock copolymer. The aliphatic amine groups in the DMAEMA A block repeat units were titrated with perchloric acid to give 0.930 milliequivalent of amine per gram of copolymer. From this titration value the composition of the triblock copolymer was found to be (mole percent repeat units found versus calculated based on monomer charge) 82.2 versus 78.5 for both nonpolar 2-ethylhexyl methacrylate B blocks, and 17.8 versus 21.5 for the polar 2-dimethylaminoethyl methacrylate A block. Conversion of the found mole percent composition to weight percent composition provided 85.38 percent for both 2-ethylhexyl methacrylate nonpolar B blocks and 14.62 percent for the polar 2-dimethylaminoethyl methacrylate A block. The BAB triblock copolymer, poly[2-ethylhexyl methacrylate (B block)-co-N,N-dimethylamino-N-ethyl methacrylate (A block)], prepared in this Example was used to prepare the charge director in Example V.

EXAMPLE IV

CHARGE DIRECTOR PREPARATION 1

Preparation of the protonated ammonium bromide AB diblock copolymer charge director, poly[2-ethylhexyl methacrylate (B block)-co-N,N-dimethyl-N-ethyl methacrylate ammonium bromide (A block)], from poly[2-ethylhexyl methacrylate (B block)-co-N,N-dimethylamino-N-ethyl methacrylate (A block)], prepared in Example II and aqueous hydrogen bromide.

To a 2.0 liter Erlenmeyer flask were added 224.7 grams of a 44.51 weight percent toluene solution of the AB diblock copolymer (100.0 grams copolymer and 124.7 grams toluene), poly(2-ethylhexyl methacrylate-co-N,N-dimethylamino-N-ethyl methacrylate) prepared in Example II. The AB diblock copolymer was comprised of 18.45 weight percent of 2-dimethylaminoethyl methacrylate (DMAEMA) repeat units and 81.55 weight percent of 2-ethylhexyl methacrylate (EHMA) repeat units. The 100.0 grams of BA diblock copolymer contained 18.45 grams (0.1174 mole) of DMAEMA repeat units. To this magnetically stirred AB diblock copolymer toluene solution at about 20° C. were added an additional 608.7 grams of toluene, 58.1 grams of methanol, and 19.39 grams (0.1150 mole of HBr) of 48 percent aqueous hydrobromic acid (Aldrich Chemicals). The charged solids level was 12.0 weight percent, assuming a quantitative conversion of the targeted 98 mole percent DMAEMA repeat units present in the base polymer, to the HBr salt. This solution was magnetically stirred for about 16 hours at ambient temperature to give a protonated ammonium bromide AB diblock charge director solution. The moderately viscous solution was then diluted with 1,900.0 grams of NORPAR 15™ in a 4 liter Erlenmeyer flask to give a 5 weight percent (based on the corresponding starting weight of the AB diblock copolymer from Example II) charge director solution after toluene and methanol rotoevaporation. Toluene and methanol were rotoevaporated in 0.5 liter batches at 50° to 60° C. for 1.0 to 1.5 hours at 40 to 60 millimeters Hg. The translucent to opaque 5 weight percent NORPAR 15™ dispersion batches of poly(2-ethylhexyl methacrylate-co-N,N-dimethyl-N-ethyl methacrylate ammonium bromide) had conductivities in the range of 7.2 to 7.7 pmhos/cm and were used to charge liquid toner in Control 1.

EXAMPLE V

CHARGE DIRECTOR PREPARATION 2

Preparation of the protonated ammonium bromide BAB triblock copolymer charge director, poly[2-ethylhexyl methacrylate (B block)-co-N,N-dimethyl-N-ethyl methacrylate ammonium bromide (A block)], from poly[2-ethylhexyl methacrylate (B block)-co-N,N-dimethylamino-N-ethyl methacrylate (A block)], prepared in Example III and aqueous hydrogen bromide.

To a 250 milliliter Erlenmeyer flask were added 15.00 grams of a 43.79 weight percent toluene solution of the BAB triblock copolymer (6.57 grams of copolymer and 8.43 grams toluene), poly[2-ethylhexyl methacrylate (B block)-co-N,N-dimethyl-N-ethyl methacrylate ammonium bromide (A block)], from poly[2-ethylhexyl methacrylate (B block)-co-N,N-dimethylamino-N-ethyl methacrylate (A block)] prepared in Example III. The BAB triblock copolymer was comprised of 14.62 weight percent of 2-dimethylaminoethyl methacrylate (DMAEMA) repeat units and 85.38 weight percent 2-ethylhexyl methacrylate (EHMA) repeat units. The 6.57 grams of BAB triblock copolymer contains 0.96 gram (0.0061 mole) of DMAEMA repeat units. To this magnetically stirred BAB triblock copolymer toluene solution at about 20° C. were added an additional 39.20 grams of toluene, 3.76 grams of methanol, and 1.01 grams (0.0060 mole of HBr) of 48 percent aqueous hydrobromic acid (Aldrich). The charged solids level was 12.0 weight percent, assuming a quantitative conversion of the targeted 98 mole percent DMAEMA repeat units present in the base polymer, to the HBr salt. This solution was magnetically stirred for about 23 hours at ambient temperature to provide a protonated ammonium bromide BAB triblock charge director solution. The moderately viscous solution was then diluted with 124.83 grams of NORPAR 15™ in a 500 milliliter Erlenmeyer flask to give a 5 weight percent (based on the corresponding starting weight of the BAB triblock copolymer from Example III) charge director solution after toluene and methanol rotoevaporation. Toluene and methanol were rotoevaporated at 60° to 70° C. for 1.0 to 1.5 hours at 40 to 60 millimeters Hg. The clear 5 weight percent NORPAR 15™ solution of poly(2-ethylhexyl methacrylate-co-N,N-dimethyl-N-ethyl methacrylate ammonium bromide) had a conductivity of 116 pmhos/cm and was used to charge liquid toner in Example VI.

CONTROL 1

YELLOW LIQUID DEVELOPERS CHARGED WITH PROTONATED AMMONIUM BROMIDE SALT AB DIBLOCK COPOLYMER CHARGE DIRECTORS

Three yellow liquid toner dispersions were prepared by selecting 27.25 grams of liquid toner concentrate (7.34 percent solids in NORPAR 15™) from Example I and adding to it sufficient NORPAR 15™ (Exxon) and 5 percent AB diblock protonated charge director, poly[2-ethylhexyl methacrylate (B block)-co-N,N-dimethyl-N-ethyl methacrylate ammonium bromide (A block)], from Example IV to provide 1 percent solids (wherein solids include resin, charge adjuvant, and yellow pigment) liquid toner dispersions containing 50, 100, and 150 milligrams or 5, 10, and 15 percent of charge director per gram of toner solids (Controls 1A, 1B, and 1C). The 5 percent AB diblock charge director used in this control was prepared from base polymer preparation 1 in Example II. After 2 hours, 1, 4, 6, and 40 days of equilibration for the yellow liquid toners charged at 50/1 and 100/1 and after 4, 7, 13, and 40 days of equilibration for the yellow liquid toner charged at 150/1, mobility and conductivity were measured for these 1 percent liquid toners to determine the toner charging rate and level. These values were compared to mobility and conductivity values obtained for the 1 percent yellow liquid toners described in Example VI containing the same three levels of protonated BAB triblock copolymer charge director per gram of toner solids after the same equilibration time periods. Table 1 in Example VI contains 200 gram formulations for yellow liquid toners or developers charged with the protonated AB diblock and the protonated BAB triblock copolymer charge directors of this invention. Table 2 in Example VI contains the corresponding mobility and conductivity values for these yellow liquid toners or developers.

EXAMPLE VI

YELLOW LIQUID DEVELOPERS CHARGED WITH PROTONATED AMMONIUM BROMIDE SALT BAB TRIBLOCK COPOLYMER CHARGE DIRECTORS

Three yellow liquid toner dispersions were prepared by selecting 27.25 grams of liquid toner concentrate (7.34 percent solids in NORPAR 15™) from Example I and adding to it sufficient NORPAR 15™ (Exxon) and 5 percent BAB triblock copolymer charge director, poly[2-ethylhexyl methacrylate (B block)-co-N,N-dimethyl-N-ethyl methacrylate ammonium bromide (A block)], from Example V to provide 1 percent solids (wherein solids include resin, charge adjuvant, and pigment) liquid toner dispersions containing 50, 100, and 150 milligrams or 5, 10 and 15 percent charge director per gram of toner solids (Examples VIA, VIB, and VIC). The 5 percent BAB triblock copolymer charge director was prepared from base polymer preparation 2 in Example III. After 2 hours, 1, 4, 6, and 40 days of equilibration for the yellow liquid toners charged at 50/1 and 100/1 and after 4, 7, 13, and 40 days of equilibration for the yellow liquid toner charged at 150/1, mobility and conductivity were measured for these 1 percent liquid toners to determine the toner charging rate and level. These values were compared to mobility and conductivity values obtained for the 1 percent yellow liquid toners described in Control 1 containing the same three levels of protonated AB diblock copolymer charge director per gram of toner solids after the same equilibration time periods. Table 1 contains 200 gram formulations for yellow liquid toners or developers charged with the protonated AB diblock and the protonated BAB triblock copolymer charge directors of this invention. Table 2 contains the corresponding mobility and conductivity values for these yellow liquid toners or developers.

TABLE 1

Yellow Liquid Developer Formulations Charged With (1) the Protonated AB Diblock Copolymer Charge Director and (2) the Protonated BAB Triblock Copolymer Charge Director

| Developer ID: Control or Example No. | Grams Toner Concentrate From Example I | Grams Added NORPAR 15™ | Grams Added 5% Charge Director (CD) in NORPAR 15™ | Example No. of CD. Prep. & CD Level in mg CD/g Toner Solids |
|---|---|---|---|---|
| Control 1A | 27.25 | 170.75 | 2.0 | Example IV: 50/1 BA |
| Control 1B | 27.25 | 168.75 | 4.00 | Example IV: 100/1 BA |
| Control 1C | 27.25 | 166.75 | 6.00 | Example IV: 150/1 BA |
| Example VIA | 27.25 | 170.75 | 2.00 | Example V: 50/1 BAB |
| Example VIB | 27.25 | 168.75 | 4.00 | Example V: 100/1 BAB |
| Example VIC | 27.25 | 166.75 | 6.00 | Example V: 150/1 BAB |

TABLE 2

Mobility and Conductivity Results for Yellow Liquid Developers Charged With (1) the Protonated AB Diblock Copolymer Charge Director and (2) the Protonated BAB Triblock Copolymer Charge Director

| Control or Example No. | Aging Time in Days | CD Level in mg CD/g Toner Solids & CD Description | Mobility $E^{-10}m^2$ /Vs | Cond. pmho /cm | Comments |
|---|---|---|---|---|---|
| Control 1A | 2 hrs. | 50/1 AB | −0.46 | 1.0 | Medium charging |
| | 1 | diblock | −1.13 | 1.0 | and very low |
| | 4 | HBr salt | −1.56 | 1.0 | conductivity |
| | 6 | copolymer | −2.09 | 1.0 | Initial chg. rate = 5.52 |
| | 40 | | −2.42 | 0.8 | mob. units/day |
| Control 1B | 2 hrs. | 100/1 AB | −0.84 | 1.0 | High charging and |
| | 1 | diblock | −1.87 | 2.0 | very low conductivity |
| | 4 | HBr salt | −2.47 | 2.0 | Initial chg. rate = |
| | 6 | copolymer | −3.21 | 2.0 | 10.08 mob. units/day |
| | 40 | | −3.90 | 1.4 | |
| Control 1C | 4 | 150/1 AB | −2.41 | 2.0 | Very high charging |
| | 7 | diblock | −2.93 | 2.0 | and very low |
| | 13 | HBr salt | −3.78 | 2.0 | conductivity |
| | 40 | copolymer | −4.70 | 1.9 | Initial chg. rate = 0.60 mob. units/day |
| Example VIA | 2 hrs. | 50/1 BAB | −0.92 | 3.0 | More rapid initial |
| | 1 | triblock | −1.55 | 3.0 | charging than Control |
| | 4 | HBr salt | −1.87 | 3.0 | 1A at low conductivity |
| | 6 | copolymer | −2.30 | 3.0 | Initial chg. rate = |
| | 40 | | −2.48 | 2.5 | 11.04 mob. units/day |
| Example VIB | 2 hrs. | 100/1 BAB | −1.18 | 6.0 | More rapid initial |
| | 1 | triblock | −2.26 | 5.0 | charging than Control |
| | 4 | HBr salt | −2.61 | 5.0 | 1B at medium |
| | 6 | copolymer | −2.78 | 5.0 | conductivity |
| | 40 | | −3.86 | 4.0 | Initial chg. rate = 14.16 mob. units/day |
| Example VIC | 4 | 150/1 BAB | −2.90 | 7.0 | More rapid initial |
| | 7 | triblock | −2.98 | 7.0 | charging than Control |
| | 13 | HBr salt | −3.35 | 7.0 | 1C at medium |
| | 40 | copolymer | −4.14 | 5.8 | conductivity |
| | | | | | Initial chg. rate = 0.73 mob. units/day |

Inspection of the mobility data in Table 2 indicates that yellow inks charged with the BAB triblock copolymer charge directors of this invention charge more rapidly than the same yellow inks charged with the AB diblock copolymer charge directors having the same molecular weight and composition as the BAB triblock copolymer charge directors. The observed charging rate enhancement for the BAB triblock copolymer charge director occurs immediately after mixing the charge director with the uncharged liquid toner and up to about 4 days later the inks charged with the BAB triblock copolymer charge director remain charged to a higher level than the inks charged with the AB diblock charge director. Thereafter, the equilibrium charging position was gradually reached for both inks (BAB and AB charged) so that after 40 days both inks charged at 50/1 and 100/1 milligrams of charge director per gram of toner solids attain about the same equilibrium charging level. Rapid initial toner charging is desirable when mixing uncharged or slightly charged partially used or unused toner with fresh charge director to avoid time delays in, for example, xerographic imaging and printing processes. It is believed that the more hydrocarbon soluble BAB triblock copolymer charge director adsorbs to a lesser extent on the surface of the toner particles (versus the corresponding AB diblock copolymer charge director) thereby resulting in a higher effective or dissolved charge director concentration for the BAB triblock copolymer charge director. The BAB triblock copolymer charge director is more soluble than the AB diblock copolymer charge director in the hydrocarbon liquid carrier used to prepare the invention liquid toners as evidenced from a visual inspection of the two charge director solutions. The BAB triblock copolymer charge director solution is clear whereas the AB diblock copolymer charge director is a dispersion.

The initial per day charging rates in Table 2 were calculated assuming a zero mobility value for the common liquid toner (prepared by diluting the liquid toner concentrate in Example I as described in Control 1 and Example VI containing zero milligrams of either charge director per gram of toner solid. The relative rates of the BAB charged liquid inks or developers to the corresponding AB charged liquid inks or developer controls are 2.00, 1.40, and 1.22 for Example VIA/Control 1A, Example VIB/Control 1B, and Example VIC/Control 1C, respectively. These ESA mobility results indicate an initial charging rate enhancement for the BAB triblock copolymer charged inks at all three charge director levels.

Other modifications of the present invention may occur to those skilled in the art subsequent to a review of the present application, and these modifications, including equivalents thereof, are intended to be included within the scope of the present invention.

What is claimed is:

1. A negatively charged liquid developer consisting essentially of a nonpolar liquid, thermoplastic resin particles, pigment, a charge adjuvant, and a BAB polymer charge director wherein A and B represent the polar and nonpolar polymer segments, respectively.

2. A liquid developer in accordance with claim 1 wherein the A block is a polar block containing an ammonium segment wherein the A block has a number average molecular weight range of from about 200 to about 120,000, and the B block is a nonpolar block with a number average molecular weight range of from about 2,000 to about 190,000.

3. A developer in accordance with claim 1 wherein the charge director is poly[2-ethylhexyl methacrylate (B block)-co-N,N-dimethyl-N-ethyl methacrylate ammonium bromide (A block)-co-2-ethylhexyl methacrylate (B block)], poly[2-ethylhexyl methacrylate (B block)-co-N,N-dimethyl-N-ethyl methacrylate ammonium tosylate (A block)-co-2-ethylhexyl methacrylate (B block)], poly[2-ethylhexyl methacrylate (B block)-co-N,N-dimethyl-N-ethyl methacrylate ammonium chloride (A block)-co-2-ethylhexyl methacrylate (B block)], poly[N,N-dibutyl methacrylamide (B block)-co-N,N-dimethyl-N-ethyl methacrylate ammonium bromide (A block)-co-N,N-dibutyl methacrylamide (B block)], poly[N,N-dibutyl methacrylamide (B block)-co-N,N-dimethyl-N-ethyl methacrylate ammonium tosylate (A block)-co-N,N-dibutyl methacrylamide (B block)], poly[N,N-dibutyl acrylamide (B block)-co-N,N-dimethyl-N-ethyl methacrylate ammonium bromide (A block)-co-N,N-dibutyl acrylamide (B block)], poly[2-ethylhexyl methacrylate (B block)-co-4-vinyl-N,N-dimethylanilinium bromide (A block)-co-2-ethylhexyl methacrylate (B block)], poly[2-ethylhexyl methacrylate (B block)-co-4-vinyl-N,N-dimethylanilinium tosylate (A block)-co-2-ethylhexyl methacrylate (B block)], poly[2-ethylhexyl methacrylate (B block)-co-N,N-dimethyl-N-methylenecarboxylate-N-ammoniumethyl methacrylate (A block)-co-2-ethylhexyl methacrylate (B block)], poly[2-ethylhexyl methacrylate (B block)-co-N,N-dimethyl-N-propylenesulfonate-N-ammoniumethyl methacrylate (A block)-co-2-ethylhexyl methacrylate (B block)], poly[2-ethylhexyl methacrylate (B block)-co-N,N-dimethyl-N-propylenephosphonate-N-ammoniumethyl methacrylate (A block)-co-2-ethylhexyl methacrylate (B block)], poly[2-ethylhexyl methacrylate (B block)-co-N,N-dimethyl-N-propylenephosphinate-N-ammoniumethyl methacrylate (A block)-co-2-ethylhexyl methacrylate (B block)], poly[2-ethylhexyl methacrylate (B block)-co-N,N-dimethyl-N-propylenesulfinate-N-ammoniumethyl methacrylate (A block)-co-2-ethylhexyl methacrylate (B block)], poly [2-ethylhexyl methacrylate (B block)-co-N,N-dimethyl-N-ethyleneoxyethylenecarboxylate-N-ammoniumethyl methacrylate (A block)-co-2-ethylhexyl methacrylate (B block)], poly[2-ethylhexyl methacrylate (B block)-co-N,N-dimethyl-N-ethyleneoxyethylenesulfonate-N-ammoniumethyl methacrylate (A block)-co-2-ethylhexyl methacrylate (B block)], poly[N,N-dibutyl methacrylamido (B block)-co-N,N-dimethyl-N-methylenecarboxylate-N-ammoniumethyl methacrylate (A block)-co-N,N-dibutyl methacrylamido (B block)], poly[N,N-dibutyl methacrylamido (B block)-co-N,N-dimethyl-N-propylenesulfonate-N-ammoniumethyl methacrylate (A block)-co-N,N-dibutyl methacrylamido (B block)], poly[N,N-dibutyl methacrylamido (B block)-co-N,N-dimethyl-N-propylenephosphonate-N-ammoniumethyl methacrylate (A block)-co-N,N-dibutylmethacrylamido (B block)], poly[N,N-dibutyl methacrylamido (B block)-co-N,N-dimethyl-N-propylenephosphinate-N-ammoniumethyl methacrylate (A block)-co-N,N-dibutylmethacrylamido (B block)], poly(N,N-dibutyl methacrylamido (B block)-co-N,N-dimethyl-N-propylenesulfinate-N-ammoniumethyl methacrylate (A block)-co-N,N-dibutylmethacrylamido (B block)], poly[2-ethylhexyl methacrylate (B block)-co-4-vinylpyridinium-N-methylenecarboxylate (A block)-co-2-ethylhexyl methacrylate (B block)], poly[2-ethylhexyl methacrylate (B block)-co-4-vinylpyridinium-N-propylenesulfonate (A block)-co-2-ethylhexyl methacrylate (B block)], poly[2-ethylhexyl methacrylate (B block)-co-4-vinylpyridinium-N-propylenephosphonate (A block)-co-2-ethylhexyl methacrylate (B block)], poly[2-ethylhexyl methacrylate (B block)-co-4-vinylpyridinium-N-propylenephosphinate (A block)-co-2-ethylhexyl methacrylate (B block)], poly[2-ethylhexyl methacrylate (B block)-co-4-vinylpyridinium-N-propylenesulfinate (A block)-co-2-ethylhexyl methacrylate (B block)], poly[2-ethylhexyl methacrylate (B block)-co-4-vinylpyridinium-N-ethyleneoxyethylenecarboxylate (A block)-co-2-ethylhexyl methacrylate (B block)], poly[2-ethylhexyl methacrylate (B block)-co-4-vinylpyridinium-N-ethyleneoxyethylenesulfonate (A block)-co-2-ethylhexyl methacrylate (B block)], or poly[4-vinylpyridinium-N-ethyleneoxyethylenephosphonate (A block)-co-2-ethylhexyl methacrylate (B block), or poly[4-vinylpyridinium-N-methylenecarboxylate-co-p-tertiary butylstyrene).

4. A liquid electrostatographic developer in accordance with claim 3 wherein the nonpolar liquid possesses a Kauributanol value of from about 5 to about 30 and is present in a major amount of from about 50 percent to about 95 weight percent.

5. A developer in accordance with claim 4 wherein the charge adjuvant is aluminum stearate.

6. A developer in accordance with claim 1 wherein the A block is an alkyl, aryl or alkylaryl ammonium containing polymer wherein alkyl, aryl, or alkylaryl moiety can be optionally substituted or unsubstituted, which A block is obtained from the monomers N,N-dimethylamino-N-2-ethyl methacrylate, N,N-diethylamino-N-2-ethyl methacrylate, N,N-dimethylamino-N-2-ethyl acrylate, N,N-diethylamino-N-2-ethyl acrylate, N,N-morpholino-N-2-ethyl methacrylate, N,N-morpholino-N-2-ethyl acrylate, 4-vinyl-pyridine, 2-vinyl-pyridine, or 3-vinyl pyridine; and wherein said B block is obtained from the monomers 2-ethylhexylmethacrylate, 2-ethoxyethyl methacrylate, 2-ethylhexyl acrylate, 2-ethoxyethyl acrylate, lauryl methacrylate, lauryl acrylate, cetyl acrylate, cetyl methacrylate, stearyl methacrylate, stearyl acrylate, butadiene, isoprene, chloroprene, mycrene, piperylene, 1-dodecene, 4-tertiary butylstyrene, or 3-tertiary butylstyrene.

7. A developer in accordance with claim 1 wherein the resin particles are comprised of a copolymer of ethylene and an α-β-ethylenically unsaturated acid selected from the group consisting of acrylic acid and methacrylic acid.

8. A developer in accordance with claim 1 wherein the resin particles are comprised of a styrene polymer, an acrylate polymer, a methacrylate polymer, a polyester, or mixtures thereof.

9. A developer in accordance with claim 1 wherein the pigment is cyan, magenta, yellow, red, green, blue, brown, mixtures thereof, or carbon black.

10. A developer in accordance with claim 1 wherein the charge director is present in an amount of from about 5 to 500 milligrams/gram and there is enabled a negatively charged developer.

11. A developer in accordance with claim 4 wherein the resin is present in an amount of from 85 percent to 99.9 percent by weight, based on the total weight of the developer solids of resin, pigment, and charge adjuvant, which charge adjuvant is present in an amount of from about 0.1 percent to about 15 percent by weight.

12. A developer in accordance with claim 4 wherein charge adjuvant is present in an amount of 0.1 to 40 percent by weight based on the total weight of developer solids.

13. A developer in accordance with claim 1 wherein the liquid is an aliphatic hydrocarbon.

14. A developer in accordance with claim 13 wherein the aliphatic hydrocarbon is a mixture of branched hydrocarbons with from about 12 to about 16 carbon atoms; or wherein the aliphatic hydrocarbon is a mixture of normal hydrocarbons with from about 12 to about 16 carbon atoms.

15. A developer in accordance with claim 14 wherein the resin particles are comprised of an alkylene polymer, a styrene polymer, an acrylate polymer, a polyester, or mixtures thereof.

16. An imaging method which comprises forming an electrostatic latent image followed by the development thereof with a liquid developer comprised of a nonpolar liquid, thermoplastic resin particles, pigment, a charge adjuvant, and a BAB polymer charge director wherein A and B represent the polar and nonpolar polymer segments, respectively, and wherein the B blocks provide for charfie director solubility.

17. An imaging method which comprises forming an electrostatic latent image followed by the development thereof with a liquid developer comprised of a nonpolar liquid, thermoplastic resin particles, pigment, a charge adjuvant, and a BAB polymer charge director wherein A and B represent the polar and nonpolar polymer segments, respectively, and wherein the B blocks provide for charge director solubility, and wherein the charge director is poly[2-ethylhexyl methacrylate (B block)-co-N,N-dimethyl-N-ethyl methacrylate ammonium bromide (A block)-co-2-ethylhexyl methacrylate (B block)], poly[2-ethylhexyl methacrylate (B block)-co-N,N-dimethyl-N-ethyl methacrylate ammonium rosylate (A block)-co-2-ethylhexyl methacrylate (B block)], poly[2-ethylhexyl methacrylate (B block)-co-N,N-dimethyl-N-ethyl methacrylate ammonium chloride (A block)-co-2-ethylhexyl methacrylate block)], poly[N,N-dibutyl methacrylamide (B block)-co-N,N-dimethyl-N-ethyl methacrylate ammonium bromide (A block)-co-N,N-dibutyl methacrylamide (B block)], poly[N,N-dibutyl methacrylamide (B block)-co-N,N-dimethyl-N-ethyl methacrylate ammonium rosylate (A block)-co-N,N-dibutyl methacrylamide (B block)], poly[N,N-dibutyl acrylamide (B block)-co-N,N-dimethyl-N-ethyl methacrylate ammonium bromide (A block)-co-N,N-dibutyl acrylamide (B block)], poly[2-ethylhexyl methacrylate (B block)-co-4-vinyl-N,N-dimethylanilinium bromide (A block)-co-2-ethylhexyl methacrylate (B block)], poly2-methylhexyl methacrylate (B block)-co-4-vinyl-N,N-dimethylanilinium tosylate (A block)-co-2-ethylhexyl methacrylate (B block)], poly[2-ethylhexyl methacrylate (B block)-co-N,N-dimethyl-N-methylenecarboxylate-N-ammoniumethyl methacrylate (A block)-co-2-ethylhexyl methacrylate (B block)], poly[2-ethylhexyl methacrylate (B block)-co-N,N-dimethyl-N-propylenesulfonate-N-ammoniumethyl methacrylate (A block)-co-2-ethylhexyl methacrylate (B block)], poly[2-ethylhexyl methacrylate (B block)-co-N,N-dimethyl-N-propylenephosphonate-N-ammoniumethyl methacrylate (A block)-co-2-ethylhexyl methacrylate (B block)], poly[2-ethylhexyl methacrylate (B block)-co-N,N-dimethyl-N-propylenephosphinate-N-ammoniumethyl methacrylate (A block)-co-2-ethylhexyl methacrylate (B block)], poly[2-ethylhexyl methacrylate (B block)-co-N,N-dimethyl-N-propylenesulfinate-N-ammoniumethyl methacrylate (A block)-co-2-ethylhexyl methacrylate (B block)], poly[2-ethylhexyl methacrylate (B block)-co-N,N-dimethyl-N-ethyleneoxyethylenecarboxylate-N-ammoniumethyl methacrylate (A block)-co-2-ethylhexyl methacrylate (B block)], poly[2-ethylhexyl methacrylate (B block)-co-N,N-dimethyl-N-ethyleneoxyethylenesulfonate-N-ammoniumethyl methacrylate (A block)-co-2-ethylhexyl methacrylate (B block)], poly[N,N-dibutyl methacrylamido (B block)-co-N,N-dimethyl-N-methylenecarboxylate-N-ammoniumethyl methacrylate (A block)-co-N,N-dibutyl methacrylamido (B block)], poly[N,N-dibutyl methacrylamido (B block)-co-N,N-dimethyl-N-propylenesulfonate-N-ammoniumethyl methacrylate (A block)-co-N,N-dibutyl methacrylamido (B block)], poly[N,N-dibutyl methacrylamido (B block)-co-N,N-dimethyl-N-propylenephosphonate-N-ammoniumethyl methacrylate (A block)-co-N,N-dibutylmethacrylamido (B block)], poly[N,N-dibutyl methacrylamido (B block)-co-N,N-dimethyl-N-propylenephosphinate-N-ammoniumethyl methacrylate (A block)-co-N,N-dibutylmethacrylamido (B block)], poly(N,N-dibutyl methacrylamido (B block)-co-N,N-dimethyl-N-propylenesulfinate-N-ammoniumethyl methacrylate (A block)-co-N,N-dibutylmethacrylamido (B block)], poly[2-ethylhexyl methacrylate (B block)-co-4-vinylpyridinium-N-methylenecarboxylate (A block)-co-2-ethylhexyl methacrylate (B block)], poly[2-ethylhexyl methacrylate (B block)-co-4-vinylpyridinium-N-propylenesulfonate (A block)-co-2-ethylhexyl methacrylate (B block)], poly[2-ethylhexyl methacrylate (B block)-co-4-vinylpyridinium-N-propylenephosphopate (A block)-co-2-ethylhexyl methacrylate (B block)], poly[2-ethylhexyl methacrylate (B block)-co-4-vinylpyridinium-N-propylenephosphinate (A block)-co-2-ethylhexyl methacrylate (B block)], poly[2-ethylhexyl methacrylate (B block)-co-4-vinylpyridinium-N-propylenesulfinate (A block)-co-2-ethylhexyl methacrylate (B block)], poly[2-ethylhexyl methacrylate (B block)-co-4-vinylpyridinium-N-ethyleneoxyethylenecarboxylate (A block)-co-2-ethylhexyl methacrylate (B block)], poly[2-ethylhexyl methacrylate (B block)-co-4-vinylpyridinium-N-ethyleneoxyethylenesulfonate (A block)-co-2-ethylhexyl methacrylate (B block)], or poly[4-vinylpyridinium-N-ethyleneoxyethylenephosphonate (A block)-co-2-ethylhexyl methacrylate (B block), or poly[4-vinylpyridinium-N-methylenecarboxylate-co-p-tertiary butylstyrene).

18. A developer in accordance with claim 1 wherein the B block provides for charge director solubility and the weight average molecular weight to number average molecular weight ratio of said triblock is about 5 to 1.

19. A negatively charged liquid developer comprised of a nonpolar liquid, thermoplastic resin particles, pigment, a charge adjuvant, and a BAB polymer charge director wherein A and B represent the polymer segments Polar A Blocks

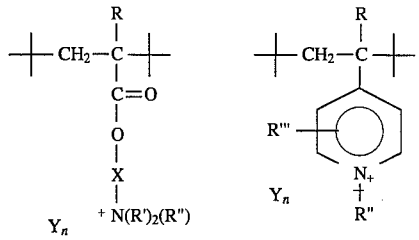

wherein R is hydrogen, alkyl of 1 to 20 carbons, cycloalkyl of 3 to about 20 carbons, aryl of 6 to 24 carbons, alkylaryl of 7 to 24 carbons, or cycloalkylaryl of 8 to 24 carbons; X is alkyl or cycloalkyl, aryl, alkylaryl, cycloalkylaryl; R' is alkyl or cycloalkyl, aryl, alkylaryl, cycloalkylaryl; R" is hydrogen, alkyl or cycloalkyl, aryl, alkylaryl, cycloalkylaryl, alkylene or a cycloalkylene conjugate acid anion, arylene, alkylarylene, arylalkylene, cycloalkylarylene, or an arylcycloalkylene conjugate acid anion; $Y^-$ is a conjugate acid anion of an acid with a pKa less than or equal to about 4.5; n is 0 or 1; n is 0 when R" contains a conjugate acid anion; n is 1 when R" does not contain a conjugate acid anion; and R"' is alkyl or cycloalkyl, aryl, alkylaryl, cycloalkylaryl of 6 to about 24 carbons, and for the nonpolar B blocks Nonpolar B Blocks

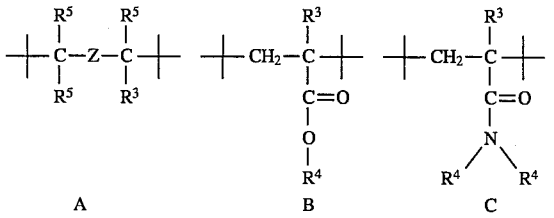

A B C $R^3$ is hydrogen in B and C, alkyl or cycloalkyl of 1 to about 30 carbons for alkyl and 3 to 35 carbons for cycloalkyl in A, B, and C; alkylaryl or cycloalkylaryl of about 10 to about 30 carbons in A, B and C; $R^4$ is alkyl or cycloalkyl in B and C; or alkylaryl or cycloalkylaryl of about 10 to about 30 carbons in A, B, and C; $R^5$ is hydrogen, alkyl or cycloalkyl in A; or alkylaryl or cycloalkylaryl of about 10 to about 30 carbons in A; Z is vinylene or arylene, or $R^6$ mono or disubstituted vinylene or arylene wherein $R^6$ is hydrogen or alkyl or cycloalkyl of 1 to 30 carbons; or aryl, alkylaryl or cycloalkylaryl of about 6 to about 30 carbons in A.

20. A negatively charged liquid developer consisting essentially of a nonpolar liquid, thermoplastic resin particles, pigment, a charge adjuvant, and a BAB polymer charge director wherein A and B represent the polar and nonpolar polymer segments, respectively, and wherein the B blocks provide for charge director solubility.

21. A developer in accordance with claim 1 wherein the BAB triblock copolymer charge director is poly[2-ethylhexyl methacrylate (B block)-co-N,N-dimethyl-N-ethyl methacrylate ammonium bromide (A block)].

22. A developer in accordance with claim 1 wherein the BAB triblock copolymer charge director is poly[2-ethylhexyl methacrylate (B block)-co-N,N-dimethyl-N-ethyl methacrylate ammonium bromide (A block)].

* * * * *